US010874179B2

(12) United States Patent
Takazawa et al.

(10) Patent No.: US 10,874,179 B2
(45) Date of Patent: Dec. 29, 2020

(54) ROTATION MECHANISM OF SEPARABLE STOPPER FOR SLIDE FASTENER AND SLIDE FASTENER INCLUDING SAME

(71) Applicant: YKK Corporation, Tokyo (JP)

(72) Inventors: Shigeyoshi Takazawa, Toyama (JP); Shigeki Annaka, Toyama (JP)

(73) Assignee: YKK Corporation

( * ) Notice: Subject to any disclaimer, the term of this patent is extended or adjusted under 35 U.S.C. 154(b) by 61 days.

(21) Appl. No.: 16/334,821

(22) PCT Filed: Sep. 30, 2016

(86) PCT No.: PCT/JP2016/079147
§ 371 (c)(1),
(2) Date: Mar. 20, 2019

(87) PCT Pub. No.: WO2018/061208
PCT Pub. Date: Apr. 5, 2018

(65) Prior Publication Data
US 2020/0015554 A1 Jan. 16, 2020

(51) Int. Cl.
*A44B 19/38* (2006.01)

(52) U.S. Cl.
CPC ..... *A44B 19/38* (2013.01)

(58) Field of Classification Search
CPC ..... A44B 19/38
See application file for complete search history.

(56) References Cited

U.S. PATENT DOCUMENTS 4,078,279 A * 3/1978 Heimberger ..... A44B 19/38 24/434
4,139,927 A * 2/1979 Heimberger ..... A44B 19/38 24/434

(Continued)

FOREIGN PATENT DOCUMENTS

JP 38989/1980 U1 3/1980
JP 55-500279 A 5/1980

(Continued)

OTHER PUBLICATIONS

International Preliminary Report on Patentability, PCT Patent Application No. PCT/JP2016/079147, dated Apr. 11, 2019.

(Continued)

*Primary Examiner* — Jason W San
(74) *Attorney, Agent, or Firm* — Kilpatrick Townsend & Stockton LLP

(57) ABSTRACT

A rotational mechanism of a separable stop member for a slide fastener may include: a first member including a first main body, an opening provided in the first main body, and one or more first contact portions provided in the opening; and a second member including a second main body, and one or more second contact portions provided, as a protrusion, in the second main body. One of the first and second contact portions may include an arc-shaped sloped surface extends in an arc about a rotational axis, and the other one of the first and second contact portions may include a sliding portion that slides on the arc-shaped sloped surface. The sliding portion may slide on the arc-shaped sloped surface such that at least one of the first and second main bodies is rotated about the rotational axis.

18 Claims, 31 Drawing Sheets

(56) References Cited

U.S. PATENT DOCUMENTS

| | | | | |
|---|---|---|---|---|
| 4,152,813 | A * | 5/1979 | Heimberger | A44B 19/38 24/434 |
| 6,088,888 | A * | 7/2000 | Oda | A44B 19/38 24/433 |
| 6,421,887 | B1 * | 7/2002 | Oda | A44B 19/38 24/433 |
| 6,481,068 | B1 * | 11/2002 | Takasawa | A44B 19/38 24/388 |
| 6,826,810 | B2 * | 12/2004 | Ichikawa | A44B 19/388 24/381 |
| 7,320,158 | B2 * | 1/2008 | Deto | A44B 19/384 24/303 |
| 7,882,602 | B2 * | 2/2011 | Himi | A44B 19/38 24/433 |
| 8,813,319 | B2 * | 8/2014 | Ogura | A44B 19/26 24/434 |
| 9,027,210 | B2 * | 5/2015 | Peters | A44B 19/384 24/433 |
| 9,549,593 | B2 * | 1/2017 | Kojima | A44B 19/388 |
| 10,292,461 | B2 * | 5/2019 | Jin | A44B 19/28 |
| 2003/0115725 | A1 * | 6/2003 | Matsumoto | A44B 19/388 24/433 |
| 2003/0213106 | A1 * | 11/2003 | Ichikawa | A44B 19/388 24/433 |
| 2005/0050699 | A1 * | 3/2005 | Yoneoka | A44B 19/38 24/433 |
| 2008/0040901 | A1 * | 2/2008 | Himi | A44B 19/38 24/433 |

FOREIGN PATENT DOCUMENTS

| | | | |
|---|---|---|---|
| JP | 17251511986 | U1 | 10/1986 |
| JP | 2004-248809 | A | 9/2004 |
| JP | 3733343 | B2 | 10/2005 |
| WO | 1979/000927 | A1 | 11/1979 |

OTHER PUBLICATIONS

International Search Report, PCT Patent Application No. PCT/JP2016/079147, dated Dec. 6, 2016.

* cited by examiner

ROTATION MECHANISM OF SEPARABLE STOPPER FOR SLIDE FASTENER AND SLIDE FASTENER INCLUDING SAME

TECHNICAL FIELD

The present disclosure concerns a rotational mechanism of a separable stop member for slide fastener and a slide fastener including the same.

BACKGROUND ART

PTL 1 discloses a separable stop member including male and female members 7, 8. Sliding plate 9 of the male member 7 is provided with an engagement leg 11, and sliding plate 10 of the female member 8 is provided with an engagement hole 12 to which the engagement leg 11 can be fitted. Sliding surface 13 is formed around the engagement leg 11, and sliding surface 14 is formed around the engagement hole 12. When the male and female members 7, 8 are to be engaged, the sliding surface 13 and the sliding surface 14 are brought into sliding and contacting state one another. Respective sliding surfaces 13, 14 are provided with a combination of two steeper sloped surfaces 18, 19 and a moderate sloped surface 20, or a combination of a steeper sloped surface 18 and a moderate sloped surface 20. When the sliding surfaces 13, 14 are arranged to face one another and if the sliding plates 9, 10 are sandwiched from above and below, an insertion plate 30 is moved toward a slider 3 being held by a holding part 21.

PTL 2 discloses that double helical structures are provided on respective surfaces of terminal members 420, 422, and the terminal members 420, 422 are sandwiched together, facilitating appropriately directed rotation for engagement of the terminal members 420, 422 (See left-top part at 10 page).

CITATION LIST

Patent Literatures

[PTL 1] Japanese Patent No. 3733343

[PTL 2] Japanese Patent Application Laid-open No. 55-500279

SUMMARY

Technical Problem

In the rotational mechanism of PTL 1, greater rotational drag may be caused between the sliding plates 9, 10 when being sandwiched from above and below, thus requiring some level of pressing force from above and below for achieving the rotation itself. Alternatively, envisioned is that a desired amount of rotation is hard to be obtained. Stop members such as ones provided with the rotational mechanisms in PTL 1 may be aimed for physically weaker person as a non-limiting application. Considering the above, the prevent inventors have newly discovered a value in providing a rotational mechanism for stop member where a desired amount of rotation can be achieved with lesser force. It should be noted that the PTL 2 involves a similar technical issue.

Solution to Problem

A rotational mechanism according to an aspect of the present disclosure may be a rotational mechanism of a separable stop member for a slide fastener, the rotational mechanism including:

a first member that includes a first main body, an opening provided in the first main body, and one or more first contact portions provided in the opening; and a second member that includes a second main body, and one or more second contact portions provided, as a protrusion, in the second main body, wherein one of the first and second contact portions includes an arc-shaped sloped surface that extends in an arc about a rotational axis, and the other one of the first and second contact portions includes a sliding portion that slides on the arc-shaped sloped surface, and wherein the sliding portion slides on the arc-shaped sloped surface such that at least one of the first and second main bodies is rotated about the rotational axis and such that an axial spacing between the first and second main bodies along the rotational axis is changed.

In some exemplary embodiments, the first member may include two or more first contact portions, and the second member may include two or more second contact portions.

In some exemplary embodiments, the number of first contact portion and the number of second contact portion may be equal.

In some exemplary embodiments, the sliding portion may be an edge of the first or second contact portion.

In some exemplary embodiments, one of the first and second contact portions may include a stopping surface that prevents the other one of the first and second contact portions from circumferentially moving about the rotational axis.

In some exemplary embodiments, the first contact portion may be protruded from a wall surface of the opening, the wall surface extending in a depth direction of the opening.

In some exemplary embodiments, the second member may further include an axial portion to which the one or more second contact portions are coupled from radially outward of the axial portion.

In some exemplary embodiments, a terminal end of the axial portion may be positioned farther away from a terminal end of the second contact portion relative to the second main body.

In some exemplary embodiments, the one or more second contact portions may further include a sloped guide surface that descends radially outward of the rotational axis.

In some exemplary embodiments, the second contact portion may have a side surface that touches a wall surface defining the opening.

In some exemplary embodiments, the first main body may have an outer peripheral part positioned around the opening, and the second member may have a protruded guide positioned around the outer peripheral part when the sliding portion slides on the arc-shaped sloped surface.

In some exemplary embodiments, one of the first and second main bodies may be provided with a housing portion, and the other one of the first and second main bodies may be provided with a housed portion housed in the housing portion, and wherein the sliding portion may slide on the arc-shaped sloped surface so that the housed portion moves from a position where the housed portion is not housed in the housing portion to a position where the housed portion is housed in the housing portion.

In some exemplary embodiments, the housing portion may have an inner surface defining an axial spacing with one of the first and second main bodies, the housed portion may have a slant surface, and the slant surface of the housed portion may face or touch the inner surface of the housing portion as the sliding portion slides on the arc-shaped sloped surface.

A stop member according to an aspect of the present disclosure may be a separable stop member for a slide fastener the separable stop member including:

a first stop member that includes the first member of the rotational mechanism of any of above-described ones, and one of first and second bars coupled to the first member; and a second stop member that includes the second member of the rotational mechanism of any of above-described ones, and the other one of the first and second bars coupled to the second member, wherein the first bar is inserted into a slider through an interspace between a top flange and a bottom flange of the slider and wherein the second bar is inserted into the slider through a rear mouth of the slider.

In some exemplary embodiments, the second bar may be configured to house the first bar at least partially.

A slide fastener according to an aspect of the present disclosure may be a slide fastener including:

a first fastener stringer that includes a first fastener tape, a first fastener element coupled to the first fastener tape, and the first stop member coupled to the first fastener tape adjacently to the first fastener element;

a second fastener stringer that includes a second fastener tape, a second fastener element coupled to the second fastener tape, and the second stop member coupled to the second fastener tape adjacently to the second fastener element; and a slider for opening and closing the first and second fastener stringers.

Advantageous Effects of Invention

According to an aspect of the present disclosure, rotation between the first and second members in the rotational mechanism may be facilitated.

DESCRIPTION OF EMBODIMENTS

Figure 1:
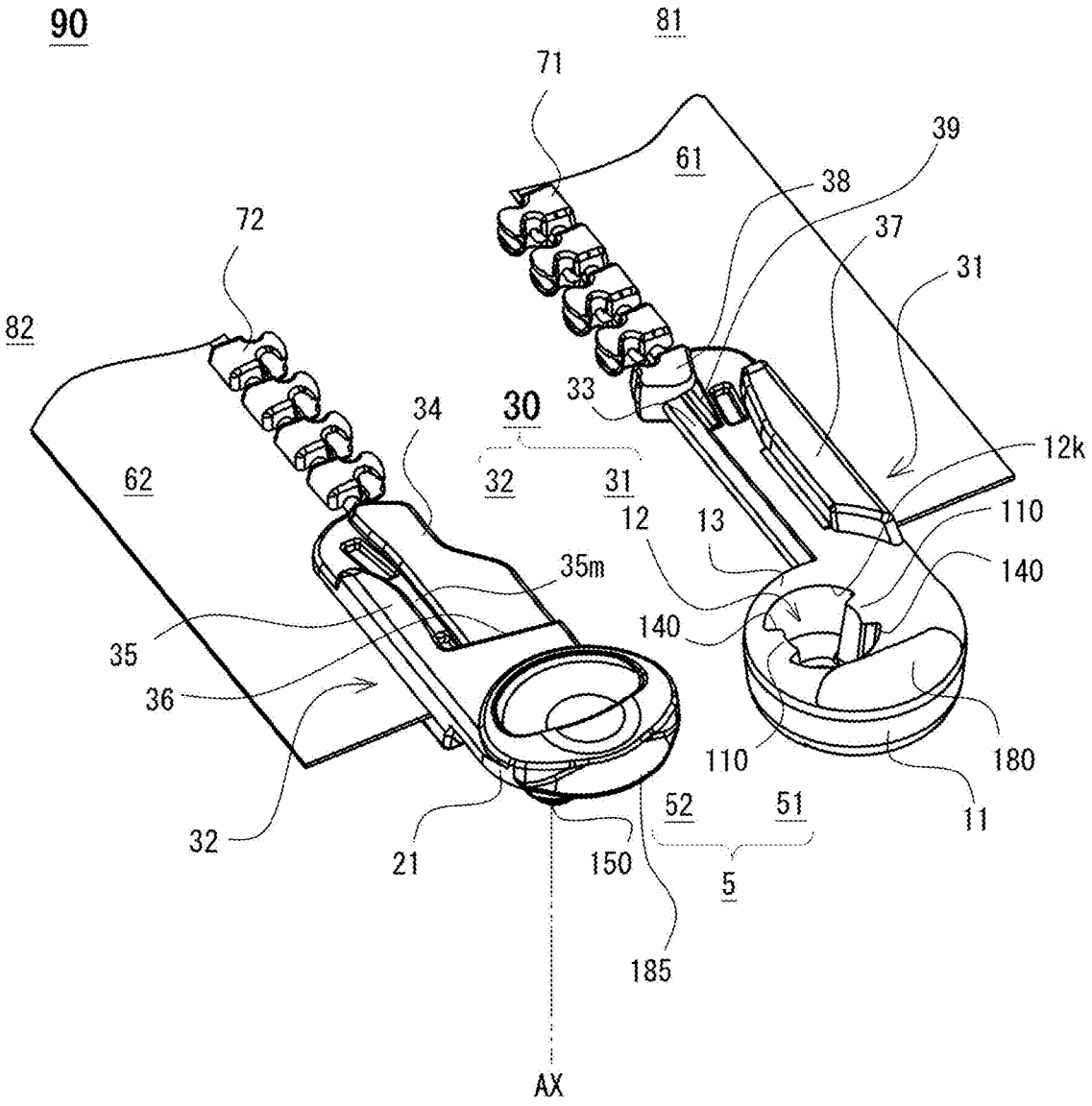
FIG. 1 is a partial perspective view of a slide fastener in unclosed state according to an exemplary embodiment of the present disclosure, particularly illustrating a separable stop member provided at an end of the slide fastener.

Hereinafter, non-limiting exemplary embodiments of the present invention will be described with reference to FIGS. 1 to 42. Disclosed one or more embodiments, one or more modified examples, and respective features included in the respective embodiments and modified examples are not mutually exclusive. A skilled person would be able to combine respective embodiments and/or respective features without requiring excess descriptions, and would appreciate synergistic effects of such combinations. Overlapping descriptions among the embodiments would be basically omitted. Referenced drawings are prepared for the purpose of illustration of invention, and may possibly be simplified for the sake of convenience of illustration.

For more precise and detail descriptions, directions will be defined as follows. Directions defined in this paragraph could possibly be redefined differently based on the following descriptions. Front-rear direction will be understood based on movement of a slider for opening and closing a slide fastener. Frontward movement of slider will close a slide fastener. Rearward movement of a slider will open a slide fastener. Left-right direction will be understood based on a pair of fastener tapes included in a slide fastener. Left-right direction is perpendicular to the front-rear direction, and is parallel to a tape surface of a fastener tape. Up-down direction is a direction perpendicular to the front-rear direction and the left-right direction. Up-down direction is perpendicular to a tape surface of a fastener tape. Tape surface of a fastener tape is one of a pair of tape surfaces defining a thickness of a thin fastener tape.

A slide fastener 90 has first and second fastener stringers 81 and 82, a slider 40 for opening and closing the first and second fastener stringers 81, 82, and a stop member 30 provided at an end of a slide fastener 90. The stop member 30 is a separable stop member dividable into first and second stop members 31, 32. The first fastener stringer 81 includes a first fastener tape 61, and a first fastener element 71 coupled to the first fastener tape 61. The first fastener stringer 81 further includes the first stop member 31 coupled to the first fastener tape 61 adjacently to the first fastener element 71. The second fastener stringer 82 includes a second fastener tape 62, and a second fastener element 72 coupled to the second fastener tape 62. The second fastener stringer 82 further includes the second stop member 32 coupled to the second fastener tape 62 adjacently to the second fastener element 72.

The slider 40 includes a top wing, a bottom wing 42, a coupling pillar 43 that couples the top wing and the bottom wing 42, and a flange 44. The flange 44 includes top flanges protruded downward and provided at left and right side-edges of the top wing, and bottom flanges protruded upward and provided at left and right side-edges of the bottom wing 42. The slider 40 may be a metal or plastic slider or other types of slider made of other materials. The slider 40 may have various functionalities such as an automatic stopping functionality and the like.

The first and second fastener tapes 61, 62 are flexible tapes such as, for example, a woven fabric or a knitted fabric or a combination of them. The first and second fastener elements 71, 72 are plastic elements, metal elements, coil-like elements or other types of elements, for example. The first and second stop members 31, 32 of the stop member 30 are integrally coupled to the respective fastener tapes 61, 62, e.g. via an injection molding of plastic material. However, in another embodiment or example, a part of or an entirety of the first and second stop members 31, 32 consists of metal. In a case the first and second stop members 31, 32 are made of metal, they will be secured to the fastener tapes 61, 62 in any appropriate way.

As described above, the stop member 30 is comprised of the first and second stop members 31, 32. The first stop member 31 includes a first member 51 of the rotational mechanism 5 included in the stop member 30, and a first bar 33 coupled to the first member 51. In the illustrated case, the first bar 33 is integrally coupled to the side-edge of the first fastener tape 61. The first bar 33 is provided between the first member 51 and the first fastener element 71. The first member 51 is not overlapped with the first fastener tape 61, and includes a portion that is positioned away from the first fastener tape 61.

The second stop member 32 includes a second member 52 of the rotational mechanism 5 included in the stop member 30, and a second bar 34 coupled to the second member 52. In the illustrated case, the second bar 34 is integrally coupled to the side-edge of the second fastener tape 62. The second bar 34 is provided between the second member 52 and the second fastener element 72. The second member 52 is not overlapped with the second fastener tape 62, and includes a portion that is positioned away from the second fastener tape 62.

The first bar 33 is inserted into the slider 40 via an interspace between the top flange and the bottom flange 44 of the slider 40. In some cases including the illustrated example, the first bar 33 is elongated in the front-rear direction. The first bar 33 is configured to be narrower as being away from the first fastener tape 61 in the left-right direction, facilitating smoother insertion into the interspace between the top flange and the bottom flange 44 of the slider 40.

The second bar 34 is inserted into the slider 40 from a rear mouth of the slider 40. In some cases including the illustrated example, the second bar 34 is elongated in the front-rear direction. The second bar 34 is configured to accommodate the first bar 33 at least partially, thus avoiding or suppressing separation of the first and second stop members 31, 32 in the up-down direction. In the illustrated example, the second bar 34 presents a U-shape in a cross-section perpendicular to the front-rear direction, and has an opening opened rightward. A housing space 34*m* of the second bar 34 extends in the front-rear direction. Front and rear ends of the housing space 34*m* of the second bar 34 are open ends.

An embodiment is envisioned where the first bar 33 is coupled to the second member 52 and the second bar 34 is coupled to the first member 51, not illustrated though.

Figure 12:
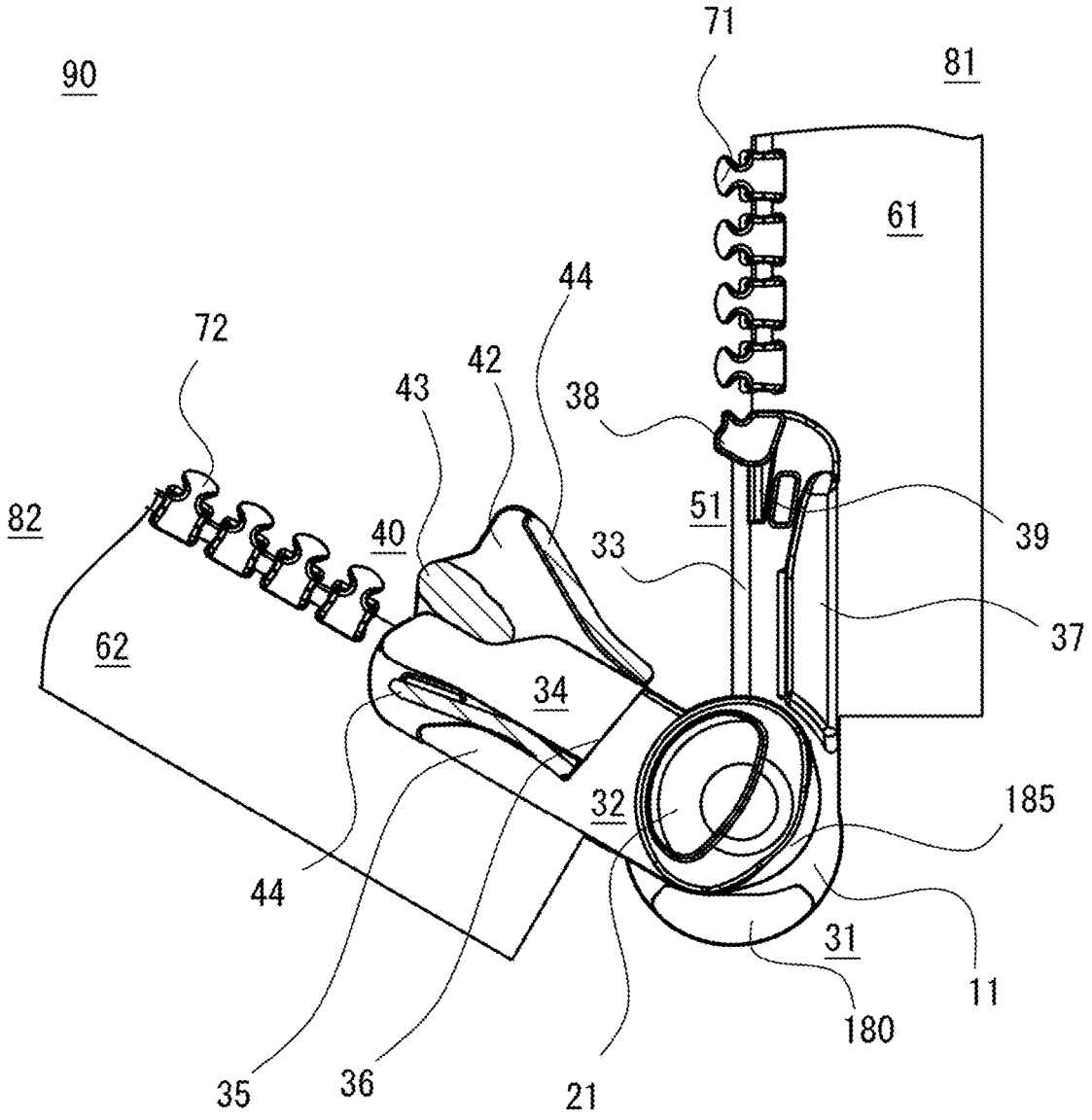
FIG. 12 is a schematic top view of a slide fastener according to an exemplary embodiment of the present disclosure, a slider being held by a second stop member, and a first contact portion of a first stop member and a second contact portion of a second stop member touching one another. A first end of an arc-shaped sloped surface provided on a second contact portion of a second stop member is touching a sliding portion of a first contact portion of a first stop member.
Figure 13:
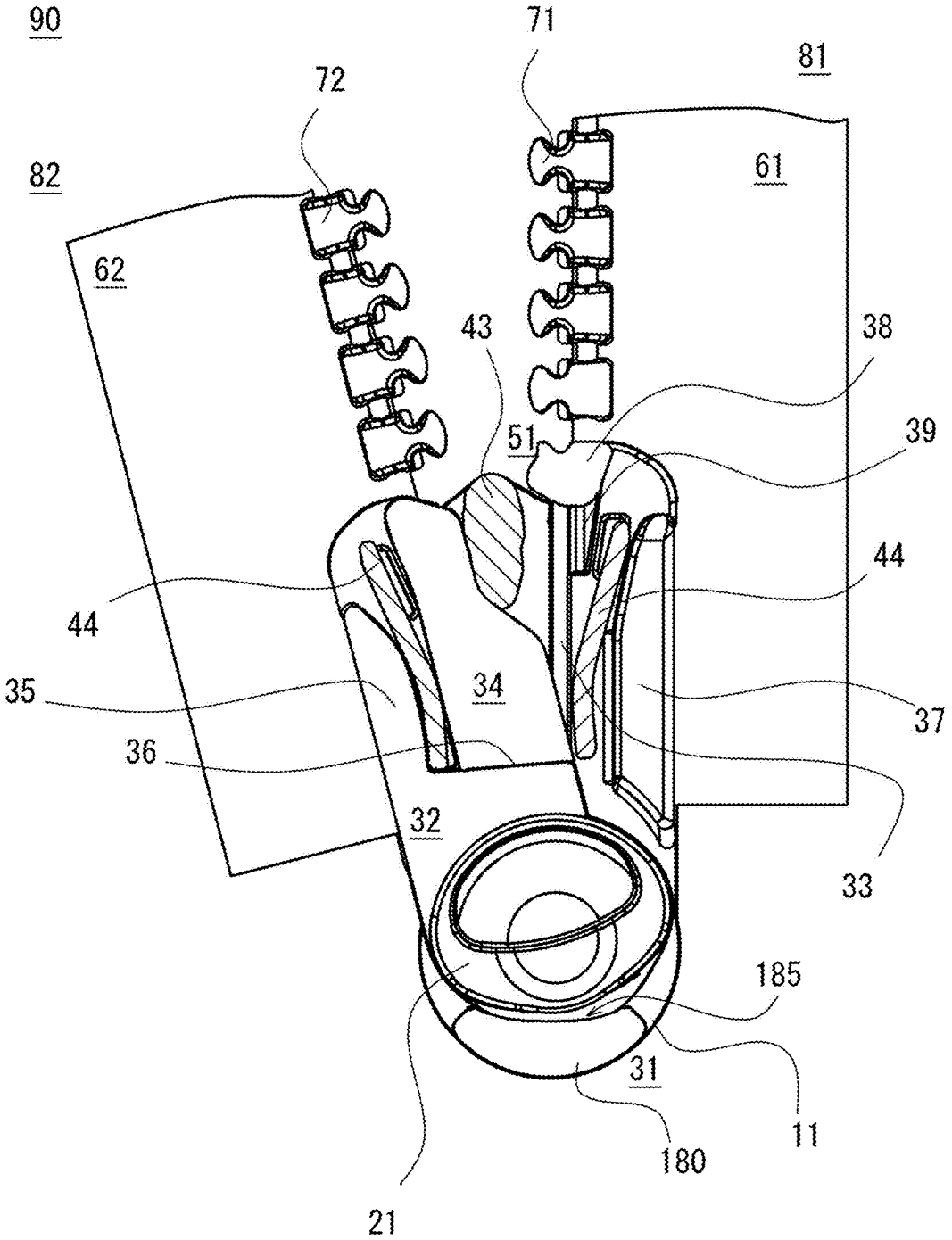
FIG. 13 is a schematic top view of a slide fastener according to an exemplary embodiment of the present disclosure, in which a slider held by a second stop member is rotated clockwise so that a first bar enters into an inside of a slider. A sliding portion, touching a first end of an arc-shaped sloped surface, slide on the arc-shaped sloped surface toward a second end of the arc-shaped sloped surface, accordingly a second stop member is rotated around a rotational axis AX relative to a first stop member and an axial spacing between first and second stop members is reduced.

Referring to FIGS. 12 and 13, the second bar 34 is inserted into the slider 40 via the rear mouth of the slider 40 so that the slider 40 is held on/over the second stop member 32. Owing to the rotational mechanism 5 of the stop member 30 described below, the second stop member 32 rotates clockwise toward the first stop member 31, and the first bar 33 is inserted into the slider 40 via the interspace between the right-side top flange and the right-side bottom flange 44 of the slider 40. When the first bar 33 enters into the inside of the slider 40 due to relative rotation between the first and second stop members 31, 32 and after the first bar 33 passes through the interspace between the top flange and the bottom flange of the slider 40, an engagement protrusion 39 described below is positioned inward of the slider 40 relative to the flanges of the slider 40, thus preventing the first bar 33 having been inserted into the slider 40 from being moved in the opposite direction to be out of the slider 40. When the stop member 30 is released from a hand and a pull tab of the slider 40 is pulled frontward to move the slider 40 frontward, the first and second fastener elements 71, 72 will be coupled and the first and second fastener stringers 81, 82 will be closed. According to the rotational mechanism 5 of the stop member 30 of the present disclosure, relative rotation between the first and second members 51, 52 of the rotational mechanism 5 may be facilitated.

More detail descriptions will be followed with reference to FIGS. 1 to 20. Additionally to the first member 51 and the first bar 33, the first stop member 31 includes a first thicker portion 37 provided adjacent to the first bar 33 and thicker than the first bar 33, a relay element 38 coupled to the front end of the first bar 33 and provided adjacent to the first fastener element 71, and the engagement protrusion 39 for preventing the first bar 33 having entered into the slider 40 from moving out of the slider 40. The first thicker portion 37 extends in the front-rear direction likewise the first bar 33, and is thicker than the first bar 33. This facilitates that the first stop member 31 is more firmly secured to the first fastener tape 61. The first thicker portion 37 includes a top half convexly protruded from the top surface of the first fastener tape 61, and a bottom half convexly protruded from the bottom surface of the first fastener tape 61.

The relay element 38 is a portion that relays movement of the slider 40 that moves frontward from a position on/over the stop member 30 toward the first and second fastener elements 71, 72. As would be understood from FIG. 12, the relay element 38 is positioned frontward of the slider 40 when the first bar 33 enters into the slider 40 in accordance with operation of the rotational mechanism 5 described below. When the slider 40 moves frontward, the relay element 38 enters into the slider 40, and next the first fastener element 71 enters into the slider 40. The relay element 38 is positioned and shaped to allow the slider 50 to move correctly toward the first fastener element 71. The relay element 38 includes a top half convexly protruded from the top surface of the first fastener tape 61 and a bottom half convexly protruded from the bottom surface of the first fastener tape 61.

The engagement protrusion 39 passes through the interspace between the top and bottom flanges of the slider 40 so that the first bar 33 having entered into the slider 40 is prevented from moving out of the slider 40, suppressing unintentional separation of the first and second stop members 31 and 32. That is, owing to the engagement protrusion 39, even if the stop member 30 is released from a hand, the first bar 33 having entered into the slider 40 is prevented from moving out of the slider 40 or the first and second stop members 31 and 32 are prevented from being separated. The engagement protrusion 39 is provided nearby the relay element 38, but may be positioned at different position in another example. The engagement protrusion 39 includes a portion convexly protruded from the top surface of the first bar 33 and a portion convexly protruded from the bottom surface of the first bar 33. Needless to say, an embodiment is envisioned where the engagement protrusion 39 is omitted.

Additionally to the second member 52 and the second bar 34, the second stop member 32 has a second thicker portion 35 arranged to form a groove with the second bar 34 into which the flange 44 of the slider 40 is inserted, and a sloped wall 36 that defines a stop position for the slider 40. The second thicker portion 35 extends in the front-rear direction like the second bar 34, and is thicker than the second bar 34. This facilitates that the second stop member 32 is more firmly secured to the second fastener tape 62. The second thicker portion 35 includes a top half convexly protruded from the top surface of the second fastener tape 62, and a bottom half convexly protruded from the bottom surface of the second fastener tape 62.

A pair of top and bottom grooves 35*m*, extending in the front-rear direction, is formed between the second bar 34 and the second thicker portion 35. In the illustrated example, a width of the groove 35 in the left-right direction has a minimum value at the middle of the front-rear direction. The minimum value of the width of the groove 35*m* in the left-right direction is equal to or slightly less than the width of the flange 44 of the slider 40 in the left-right direction. When the flange 44 of the slider 40 is inserted into the groove 35*m*, the flange 44 of the slider 40 passes through a narrowed-width section of the groove 35*m* in the left-right direction, and the rear end of the top wing and/or the bottom wing 42 of the slider 40 collides with the sloped wall 36. As would be understood from FIG. 12, the slider 40 is held over the second stop member 32 such that the slider 40 is slanted relative to the front-rear direction along which the second bar 34 extends. That is, while being inserted into the groove 35*m*, the rear side of the slider 40 touches the sloped wall 36 and the guide column 43 of the slider 40 touches the second bar 34 so that the slider 40 is slanted relative to the front-rear direction along which the second bar 34 extends. The groove 35*m* has an increasing width in the left-right direction toward the sloped wall 36 from a location where its width in the left-right direction has a minimum value so that a dent 35*k* is formed in the second thicker portion 35. A portion of the rear side of the flange 44 is inserted into the dent 35*k*, thus preventing the slider 40 from moving frontward. Accordingly, the first bar 33 or the relay element 38 can be more easily entered into the slider 40.

Figure 2:
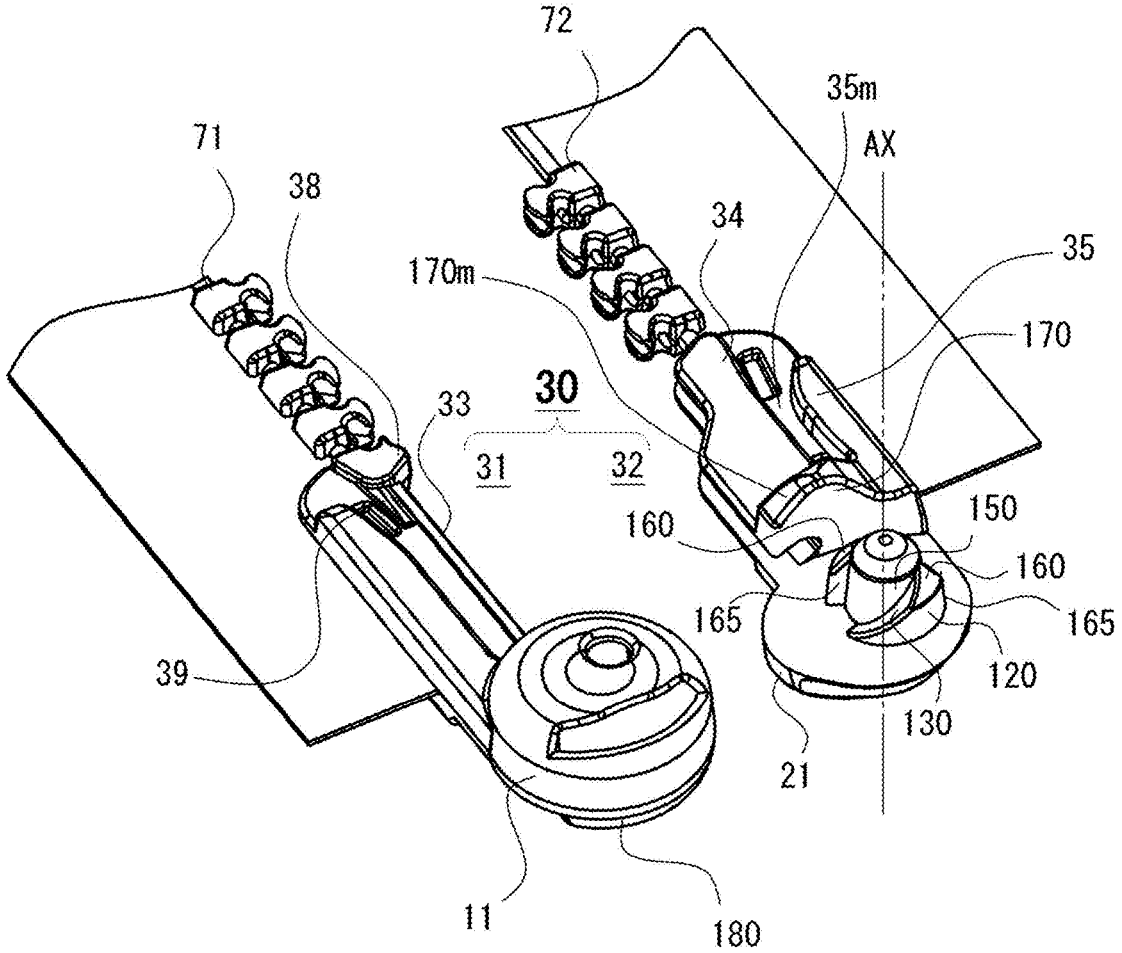
FIG. 2 is a partial perspective view of a slide fastener in unclosed state according to an exemplary embodiment of the present disclosure, illustrating an opposite side of one shown in FIG. 1.
Figure 3:
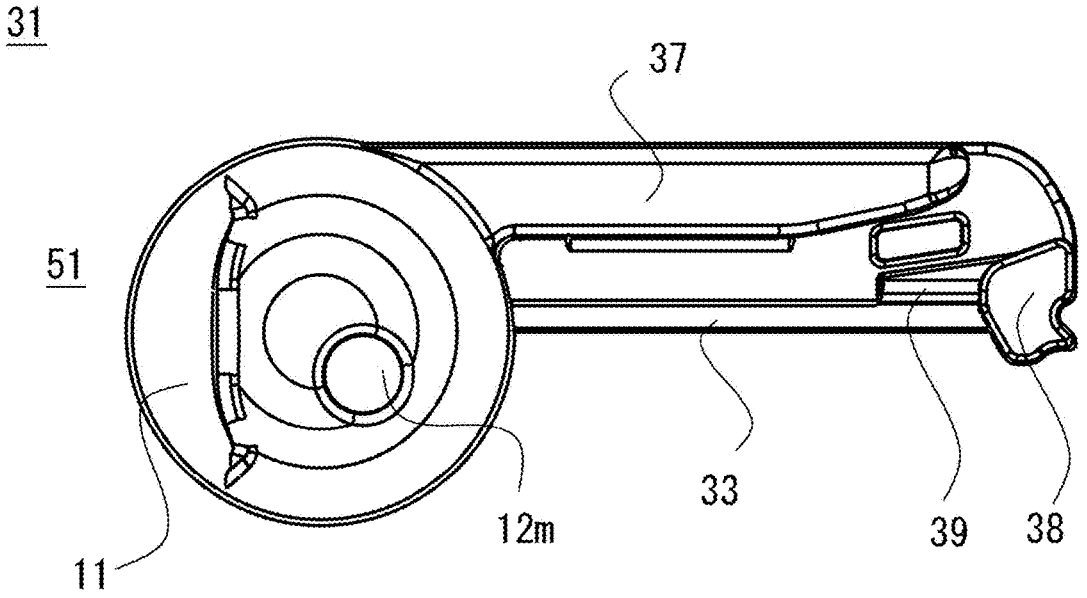
FIG. 3 is a schematic bottom view of a first stop member included in a stop member according to an exemplary embodiment of the present disclosure.
Figure 4:
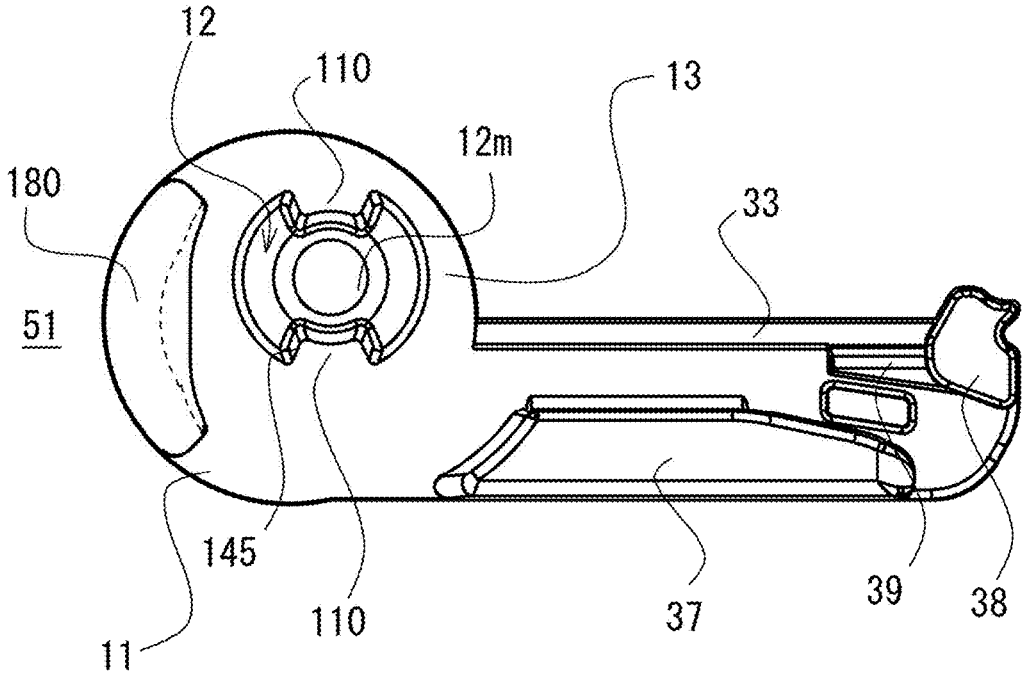
FIG. 4 is a schematic top view of a first stop member included in a stop member according to an exemplary embodiment of the present disclosure.

The rotational mechanism 5 in the stop member 30 includes a first member 51 that is a part of the first stop member 31, and a second member 52 that is a part of the second stop member 32. Simply speaking, the rotational mechanism 5 includes or is configured by the first and second members 51, 52. As shown in FIGS. 1 and 2 and so on, the first member 51 has a first main body 11, an opening 12 provided in the first main body 11, and one or more first contact portions 110 provided in the opening 12. The second member 52 has a second main body 21, and one or more second contact portions 120 provided on and protruded from the top surface of the second main body 21.

In the presently disclosed exemplary embodiment, one of the first and second contact portions 110, 120 includes an arc-shaped sloped surface 130 that extends in an arc about a rotational axis AX. The other one of the first and second contact portions 110, 120 includes a sliding portion 140 that slides on the arc-shaped sloped surface 130. The sliding portion 140 slides on the arc-shaped sloped surface 130 such that at least one of the first and second main bodies 11, 21 is rotated about the rotational axis AX and such that an axial spacing between the first and second main bodies 11, 21 along the rotational axis AX is changed. This facilitates rotation between the first and second members 51, 52 of the rotational mechanism 5. For example, a desired amount of rotation between the first and second members 51, 52 may be obtained with lesser force.

In an exemplary embodiment shown in FIGS. 1-20, the second contact portion 120 includes an arc-shaped sloped surface 130 that extends in an arc about a rotational axis AX. The first contact portion 110 includes a sliding portion 140 that slides on the arc-shaped sloped surface 130. The sliding portion 140 slides on the arc-shaped sloped surface 130 such that at least one of the first and second main bodies 11, 21 is rotated about the rotational axis AX and such that an axial spacing between the first and second main bodies 11, 21 along the rotational axis AX is changed. The change stated here may include that the axial spacing between the first main body 11 and the second main body 21 is increased or the axial spacing between the first main body 11 and the second main body 21 is reduced. While the axial spacing is increased, one of the first and second main bodies 11, 12 is moved away from the other one. While the axial spacing is reduced, one of the first and second main bodies 11, 12 is moved closer to the other one. In a case shown in FIGS. 12 and 13, the second main body 21 rotates clockwise about the rotational axis AX relative to the first main body 11 which is stationary so that the second main body 21 is moved closer to the stationary first main body 11 and so that the interspacing between the first and second main bodies 11, 21 in the up-down direction is reduced. An embodiment is envisaged where the first main body 11 is rotated relative to a stationary second main body 21. An embodiment is envisaged where the first and second main bodies 11, 21 both are rotated.

In some cases including the illustrated example, the first main body 11 is a circular disk when viewed from above. The first main body 11 is coupled to the first bar 33 and the first thicker portion 37 at its outer periphery of the disk. Specific shape of the first main body 11 may be various. For example, the first main body 11 may be shaped like a triangle or rectangle.

The opening 12 is provided at a position offset relative to the center of the perfect circle of the first main body 11. The opening 12 may be an opening with or without a bottom that receives the second contact portion 120 of the second member 52. In the illustrated example, the bottom of the opening 12 is provided with a hole 12*m*. The opening 12 has a first open end for receiving the second contact portion 120. The first open end is shaped like a perfect circle when viewed from above, but presents a deformed open shape in accordance with the first contact portion 110.

The first contact portion 110 is provided in the opening 12. In the illustrated example, the first contact portion 110 is protruded from the wall surface 12*k* of the opening 12 extending in the depth direction of the opening 12, in more detail is protruded radially inwardly from the wall surface 12*k* of the opening 12. The first contact portion 110 is provided with a surface that is flush with a main surface of the first main body 11. An embodiment is envisaged where the first contact portion 110 is protruded from any surface other than the wall surface 12*k*, e.g. a bottom surface of the opening 12.

Figure 5:
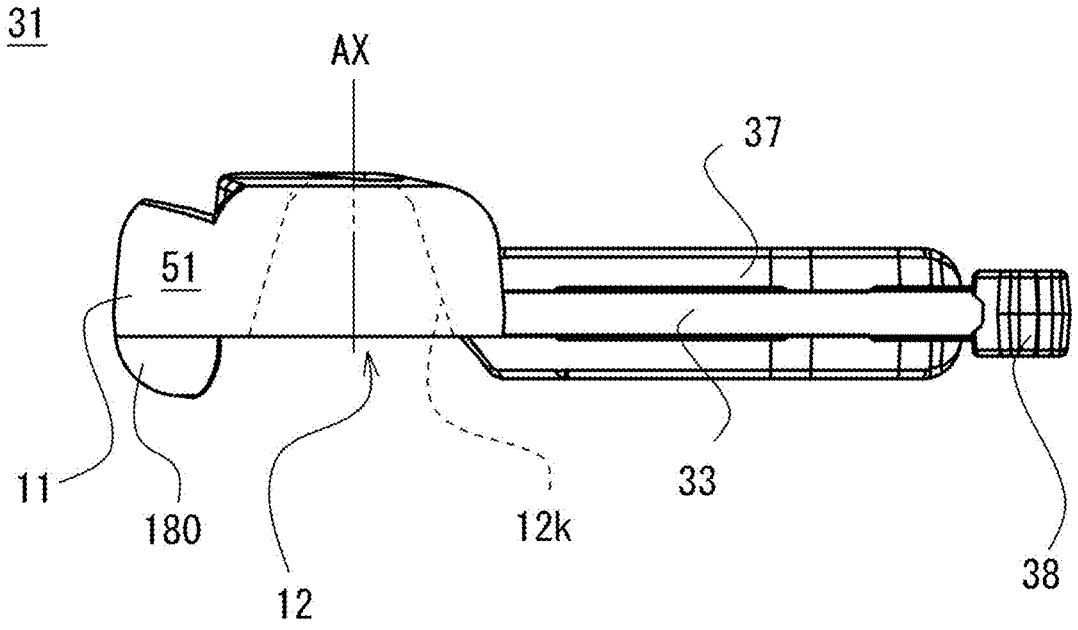
FIG. 5 is a schematic side view of a first stop member included in a stop member according to an exemplary embodiment of the present disclosure.
Figure 6:
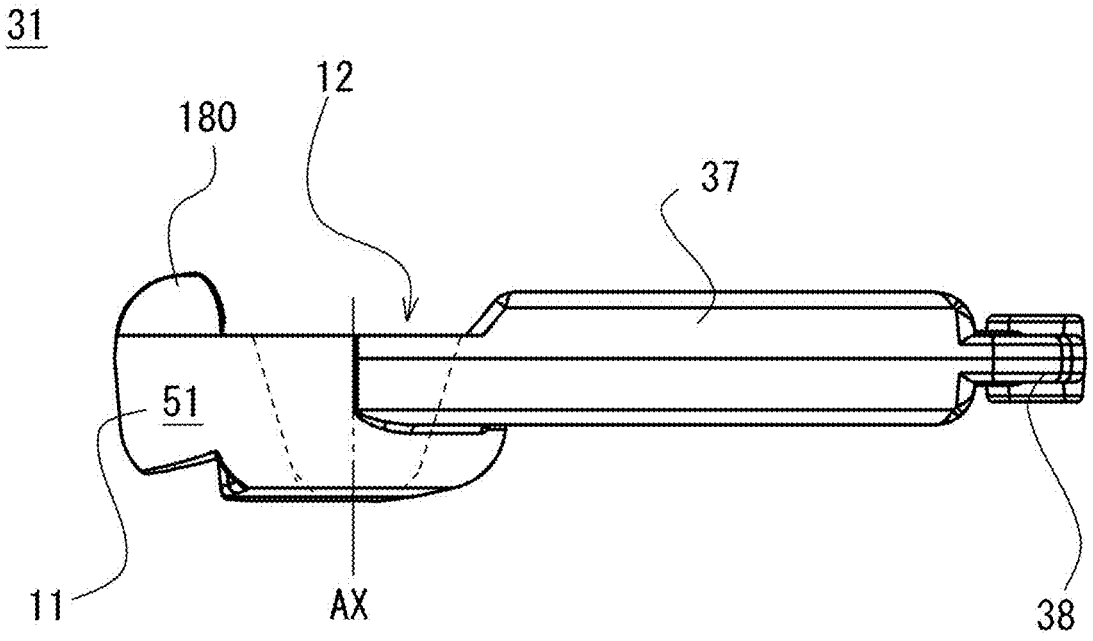
FIG. 6 is another schematic side view of a first stop member included in a stop member according to an exemplary embodiment of the present disclosure.
Figure 7:
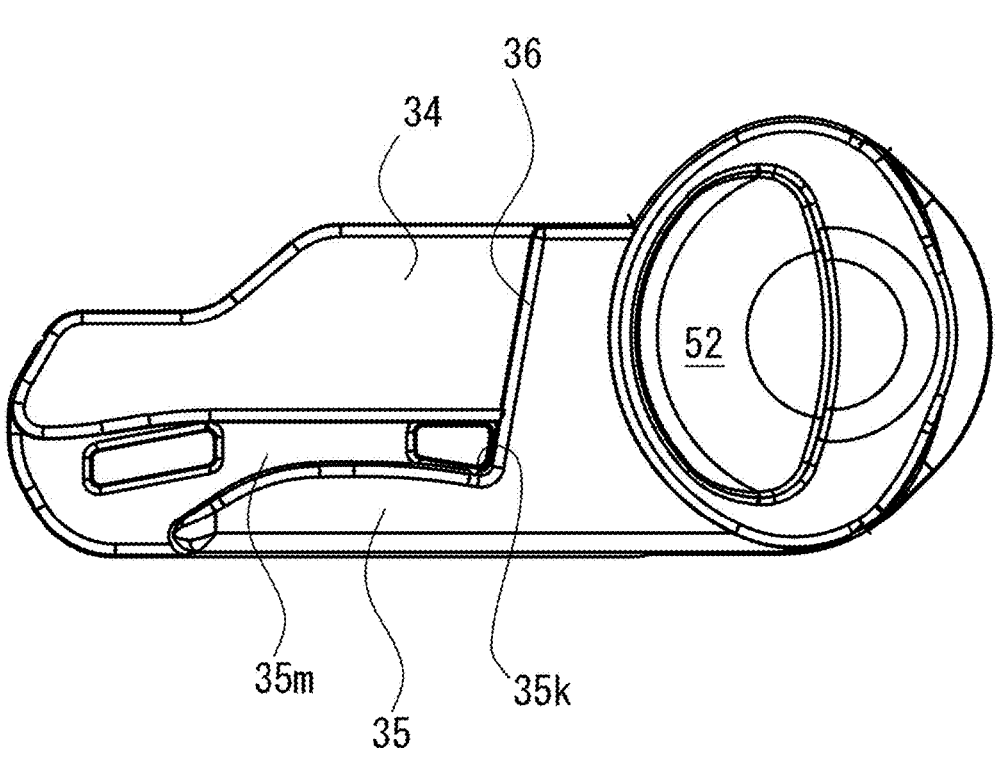
FIG. 7 is a schematic top view of a second stop member included in a stop member according to an exemplary embodiment of the present disclosure.
Figure 8:
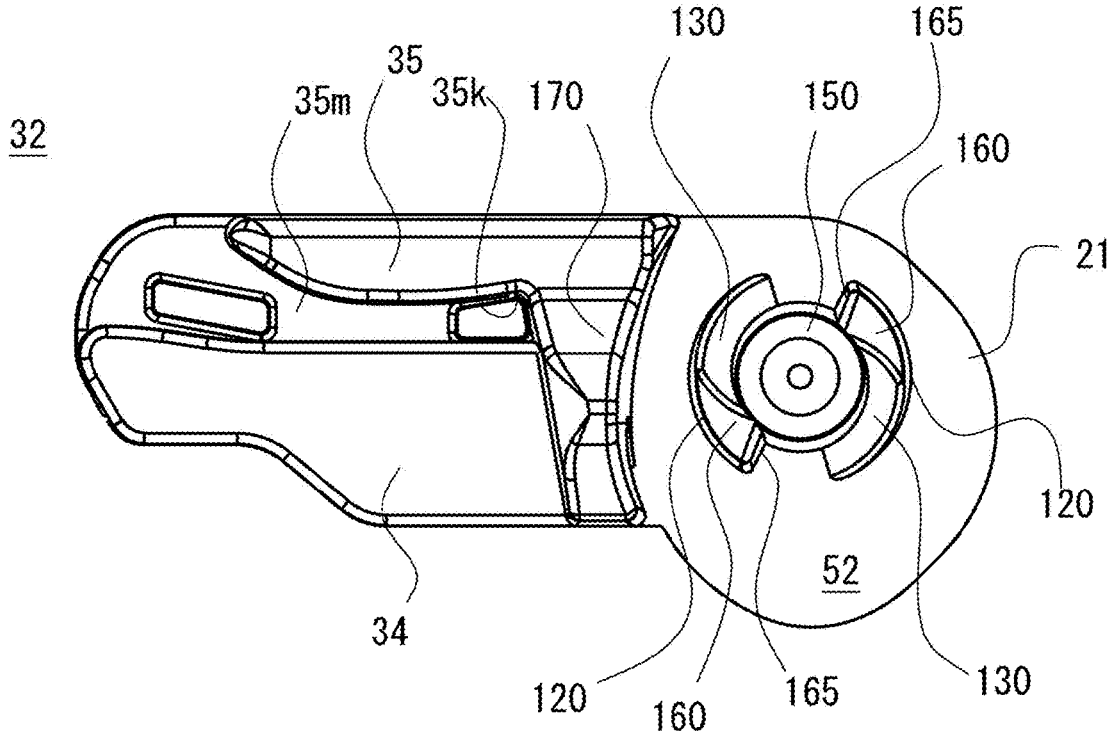
FIG. 8 is a schematic bottom view of a second stop member included in a stop member according to an exemplary embodiment of the present disclosure.
Figure 9:
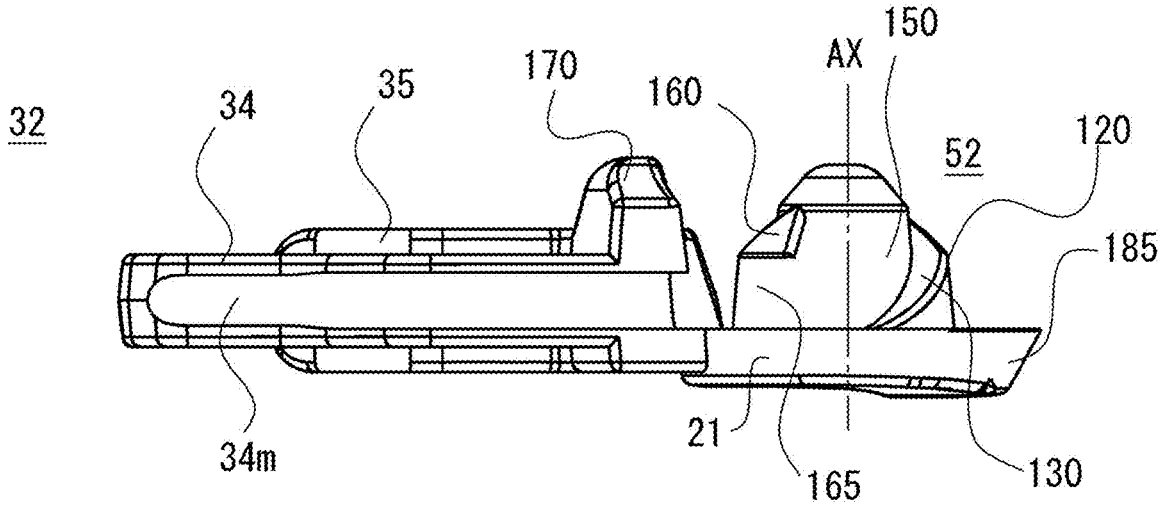
FIG. 9 is a schematic side view of a second stop member included in a stop member according to an exemplary embodiment of the present disclosure.
Figure 10:
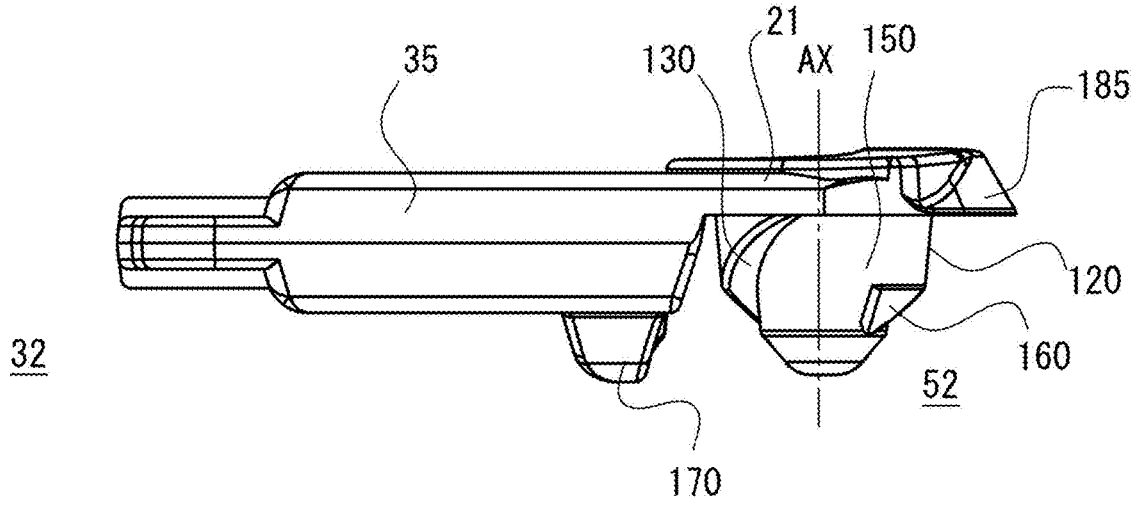
FIG. 10 is another schematic side view of a second stop member included in a stop member according to an exemplary embodiment of the present disclosure.

As would be well understood from FIGS. 5 and 6, the width or diameter of the opening 12 changes along the up-down direction or along the rotational axis AX. In particular, a width or diameter of the opening 12 is reduced as being away from the first open end of the opening 12 for receiving the second contact portion 120. Wider width or diameter of the first open end of the opening 12 allows easier insertion of the second contact portion 120 into the opening 12.

In some cases including the illustrated example, the first member 51 has two or more first contact portions 110. In the illustrated case, the first member 51 has two first contact portions 110. The two first contact portions 110 face one another having an interspacing in the opening 12 and are protruded radially inwardly in the opposite direction from the wall surface 12*k* of the opening 12. Radial interspacing between the two first contact portions 110 is reduced as being away from the first open end of the opening 12. As would be clearer from modified examples described below, different numbers of first contact portions 110 would be employed in different embodiments.

The second main body 21 is a portion to be placed onto the first main body 11. A shape of the second main body 21 when viewed from above is different from a shape of the first main body 11 when viewed from above. In the illustrated example, the shape of the second main body 21 when viewed from above is ellipse in contrast to a circle of the first main body 11. Any other shapes of second main bodies 21 would be employed in different embodiments.

The second contact portion 120 is provided on the second main body 21, more particularly is protruded from the bottom surface thereof. The second contact portion 120 extends along the rotational axis AX, i.e. downward as illustrated. In some cases including the illustrated example, the second member 52 has two or more second contact portions 120. In the illustrated case, the second member 52 has two second contact portions 120. The two second contact portions 120 are arranged to have interspacing, i.e. equally spaced about the rotational axis AX. That is, the two second contact portions 120 are arranged at 180° interval. As would be clearer from modified examples described below, different numbers of second contact portions 120 would be employed in different embodiments.

In some cases including the illustrated example, the second member 52 additionally has an axial portion 150 to which the one or more second contact portions 120 are coupled from radially outward. The axial portion 150 extends along the rotational axis AX from the second main body 21. The elongated center line of the axial portion 150 matches the rotational axis AX. Likewise the second contact portion 120, the axial portion 150 is housed in the opening 12 of the first member 51. In some cases, a terminal end of the axial portion 150 is positioned farther than a terminal end of the second contact portion 120 relative to the second main body 21. Initial alignment between the first and second members 51, 52 would be ensured when the axial portion 150 of the second member 52 enters into the opening 12 of the first member 51. In the illustrated example, the terminal end of the axial portion 150 presents a conical shape so that much easier alignment would be facilitated.

In some cases including the illustrated example, the second contact portion 120 has a sloped guide surface 160 that descends radially outwardly relative to the rotational axis AX. The sliding portion 140 of the first contact portion 110 can smoothly enter onto the arc-shaped sloped surface 130 via the sloped guide surface 160. A circumferential width of the sloped guide surface 160 about the rotational axis AX is reduced as being away from the second main body 21.

Figure 11:
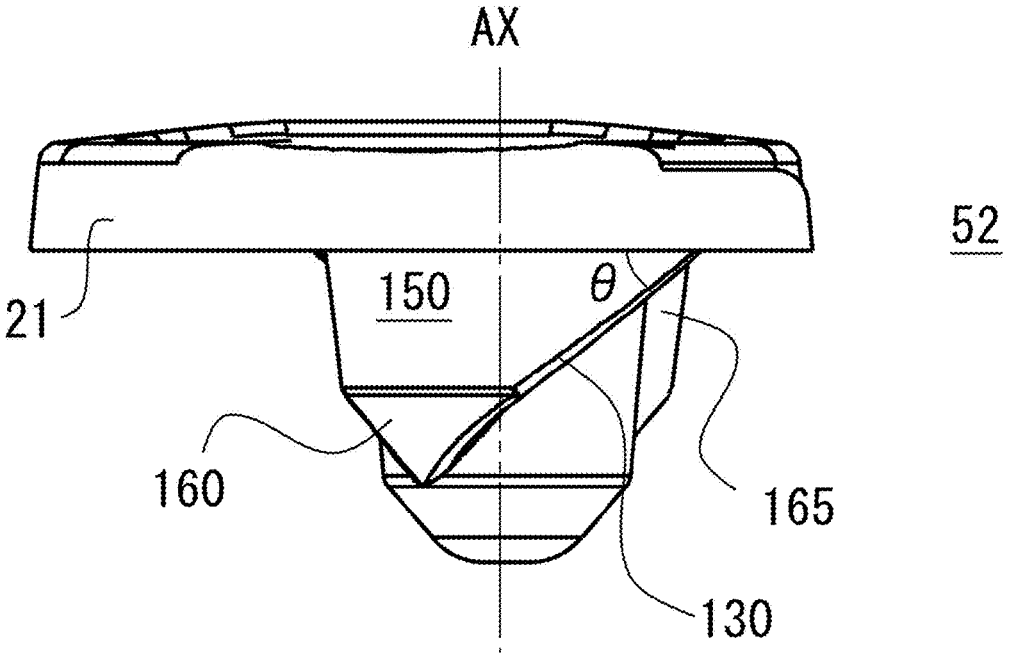
FIG. 11 is schematic still another side view of a second stop member included in a stop member according to an exemplary embodiment of the present disclosure.

The arc-shaped sloped surface 130 of the second contact portion 120 extends so as to draw a spiral about the rotational axis AX. As the arc-shaped sloped surface 130 extends about the rotational axis AX, its position or height in an axial direction of the rotational axis AX changes. More specifically, the arc-shaped sloped surface 130 has a first end positioned farthest from the second main body 21 and a second end positioned nearest to the second main body 21 or coupled to the second main body 21. While the sliding portion 140 of the first contact portion 110 moves from the first end to the second end of the arc-shaped sloped surface 130, the sliding portion 140 approaches the second main body 21. In the illustrated example, the sliding portion 140 finally touches the second main body 21 and the first and second main bodies 11, 21 are stacked. When the axial portion 150 and/or the second contact portion 120 enters into the opening 12, the first and second main bodies 11, 21 are not stacked. The arc-shaped sloped surface 130 may possibly be steeper such that temporal desired amount of rotation is obtained by sandwiching the first and second main bodies 11, 21 from above and below. It should be noted that gradient θ of the arc-shaped sloped surface 130, relative to the main surface of the second main body 21 on which the second contact portion 120 is provided as schematically illustrated in FIG. 11, may satisfy $10° < \theta < 80°$, more preferably $30° < \theta < 60°$. The main surface of the second main body 21 is opposed to the main surface of the first main body 11 where the opening 12 is provided. The main surfaces of the respective main bodies are flat surfaces and belong to respective planes perpendicular to the rotational axis.

In some cases including the illustrated example, one of the first and second contact portions 110, 120 has a stopping surface 165 that prevents the other one of the first and second contact portions 110, 120 from circumferentially moving about the rotational axis AX. In the illustrated example, the second contact portion 120 has a stopping surface 165 that prevents the first contact portion 110 from circumferentially moving about the rotational axis AX. The stopping surface 165 extends substantially perpendicular to the surface of the second main body 21 on which the second contact portion 120 is provided. In the illustrated example, a circumferential interval between the stopping surface 165 of one of the second contact portions 120 and the second end of the arc-shaped sloped surface 130 of the other one of the second contact portions 120 is set to a distance capable of receiving the first contact portion 110 suitably therebetween, e.g. set to be substantially equal to a circumferential width of the first contact portion 110 in the illustrated example.

In some cases including the illustrated example, the sliding portion 140 is an edge 145 of the first or second contact portion 110, 120. In the illustrated example, the sliding portion 140 is an edge 145 of the first contact portion 110. More specifically, the sliding portion 140 is an edge 145 of the first contact portion 110 that extends radially of the opening 12. The edge 145 is arranged between a top surface of the first contact portion 110 and a side surface of the first contact portion 110 that is arranged to cross the circumstantial direction of the opening 12.

In some cases including the illustrated example, one of the first and second main bodies 21, 22 is provided with the housing portion 180, and the other one of the first and second main bodies 21, 22 is provided with a housed portion 185 to be housed in the housing portion 180. In the illustrated example, the first main body 11 is provided with a housing portion 180, and the second main body 21 is provided with a housed portion 185. As the sliding portion 140 slides on the arc-shaped sloped surface 130, the housed portion 185 is moved from a position where not housed in the housing portion 180 to a position where housed in the housing portion 180. FIGS. 12-17 illustrate a process how the housed portion 185 of the second main body 21 is housed in the housing portion 180 of the first main body 11. Separation of the first and second main bodies 11, 21 in the up-down direction would be thus avoided or suppressed.

Figure 16:
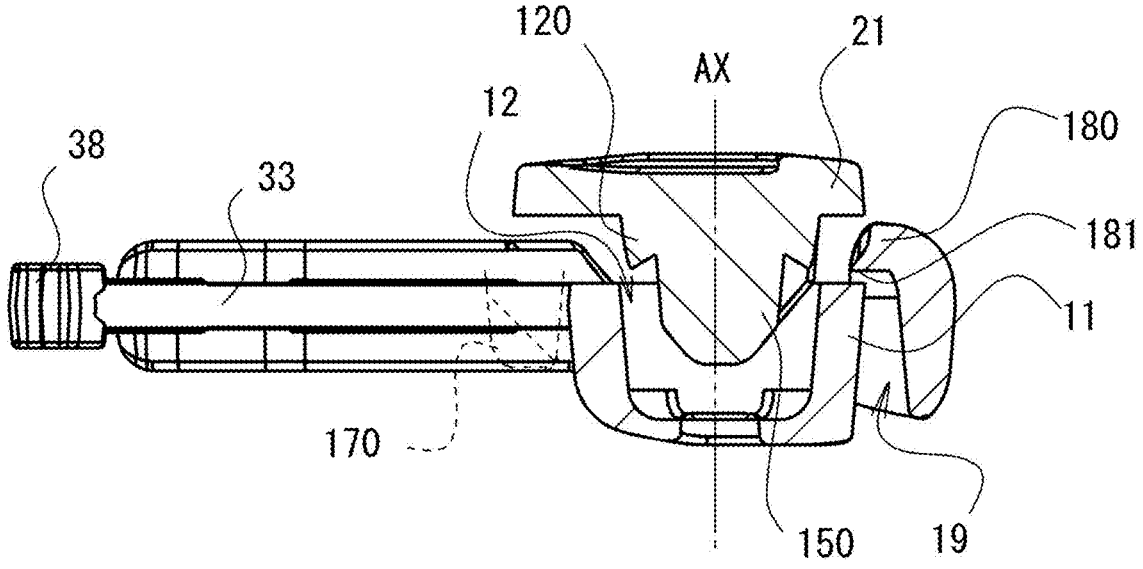
FIG. 16 is a schematic cross-sectional view of a stop member according to an exemplary embodiment of the present disclosure, schematically illustrating a manner of engagement between the first and second contact portions.
Figure 17:
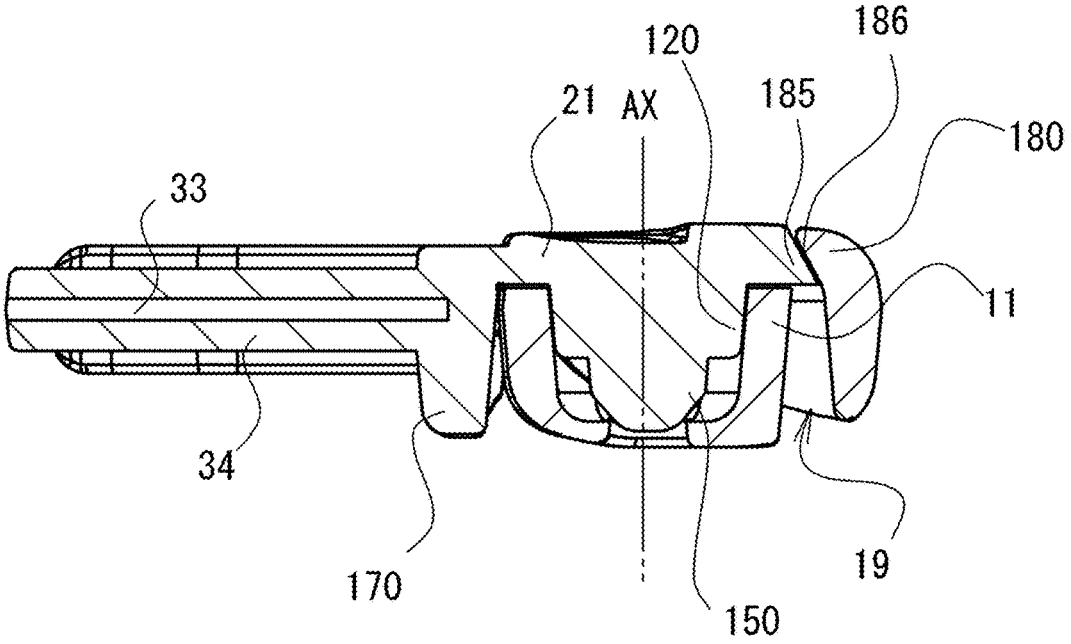
FIG. 17 is a schematic cross-sectional view of a stop member according to an exemplary embodiment of the present disclosure, schematically illustrating a manner of engagement between the first and second contact portions. Comparison between FIG. 16 and FIG. 17 would schematically illustrate axial displacement of protruded guide.

As shown in FIGS. 16 and 17, the housing portion 180 has an inner surface 181 that defines an axial interspacing with the first main body 11, and the housed portion 185 has a slant surface 186. As the sliding portion 140 slides on the arc-shaped sloped surface 130, the slant surface 186 of the housed portion 185 faces or touches the inner surface 181 of the housing portion 180. The housed portion 185 is shaped to allow easier insertion of the housed portion 185 into the housing portion 180 when the sliding portion 140 slides on the arc-shaped sloped surface 130, e.g. has the slant surface 186 in the illustrated example. Coupling between the housing portion 180 and the housed portion 185 may be enhanced. It should be noted that, in a case where the housing portion 180 is provided at the second main body 21, the housing portion 180 has an inner surface that defines an axial interspacing with the second main body 21.

As shown in FIGS. 16 and 17, the housed portion 185 is a section of the ellipse-shaped outer periphery of the second main body 21 when viewed from above, i.e. a section thereof where the ellipse has its maximum width. As the second main body 21 rotates about the rotational axis AX, the housed portion 185 approaches the housing portion 180 and would finally be housed in the housing portion 180, i.e. would be sandwiched between the above-described inner surface 181 of the housing portion 180 and the main surface of the first main body 11. The housed portion 185 may be configured more suitably by changing a shape of housed portion 185 when viewed from above and a thickness of the second main body 21. In another example, the housed portion 185 may be configured differently.

In the illustrated example, the housing portion 180 is provided, as a protrusion, on the main surface of the first main body 11 on which the first open end of the opening 12 is provided to which the second contact portion 120 is inserted. The protruded housing portion 180 is provided to cross an extended line of the first fastener element 71. Foreign matter would be effectively prevented from entering into an interspace between the first and second main bodies 11, 21.

In some cases including the illustrated example, the first main body 11 has an outer peripheral part 13 positioned around the opening 12 and/or at least partially surrounds the opening 12. The second member 52 has a protruded guide 170 that will be positioned around the outer peripheral part 13 when the sliding portion 140 slides on the arc-shaped sloped surface 130. The protruded guide 170 has a sloped guide surface **170*m* where the thickness in the direction of the rotational axis AX is reduced as being away from the first fastener tape 61 in the left-right direction. The protruded guide 170 reduces a possibility of non-parallel arrangement of the first and second main bodies 11, 21 when the second contact portion 120 failed to enter into the opening 12 suitably. In the illustrated example, a height of the protruded guide 170 from the second main body 21 is substantially equal to a height of the axial portion 150 from the second main body 21. In other words, a terminal end of the protruded guide 170 and a terminal end of the axial portion 150 exist substantially in a common plane that is perpendicular to the rotational axis AX, and may be protruded relative to a bottom wing of a slider when a slider 40 is held on the second stop member 32**.

When the first and second members 51, 52 are moved closer to one another while the protruded guide 170 is positioned over a first bar 33 of a first member 51, the protruded guide 170 would firstly touch the first bar 33, and the first bar 33 would slide on the sloped guide surface **170*m* of the protruded guide 170 along a descending direction of the sloped guide surface 170*m* so that interference between the first bar 33 and the bottom wing 42 of the slider 40 would be well avoided or suppressed. While the first bar 33 descends the sloped guide surface 170*m* or after that, the second contact portion 120 and/or the axial portion 150 may enter into the opening 12** suitably.

A direction of movement of the first bar 33 while the first bar 33 slides on the sloped guide surface **170*m* of the protruded guide 170 is opposite to a direction of movement of the first bar 33 while the sliding portion 140 slides on the arc-shaped sloped surface 130. When the rotational axis AX is taken as a center, movement of the first bar 33 while the first bar 33 slides on the sloped guide surface 170*m* of the protruded guide 170 is equal to rotation in a first direction. When the rotational axis AX is taken as a center, movement of the first bar 33 while the sliding portion 140 slides on the arc-shaped sloped surface 130 is equal to rotation in a second direction opposite to the first direction. It would be possible to describe that one of the first and second directions is clockwise and the other one is counter clockwise. After the first bar 33 finishes descending the sloped guide surface 170*m*, the sliding portion 140 touches the arc-shaped sloped surface 130 and starts to slide on the arc-shaped sloped surface 130. In a case where the second member 52 is provided with the protruded guide 170, a corresponding space of height of the second contact portion 120 and/or the axial portion 150 can be allocated for the protruded guide 170. A terminal end of the protruded guide 170 is positioned over the second bar 34**.

Figure 14:
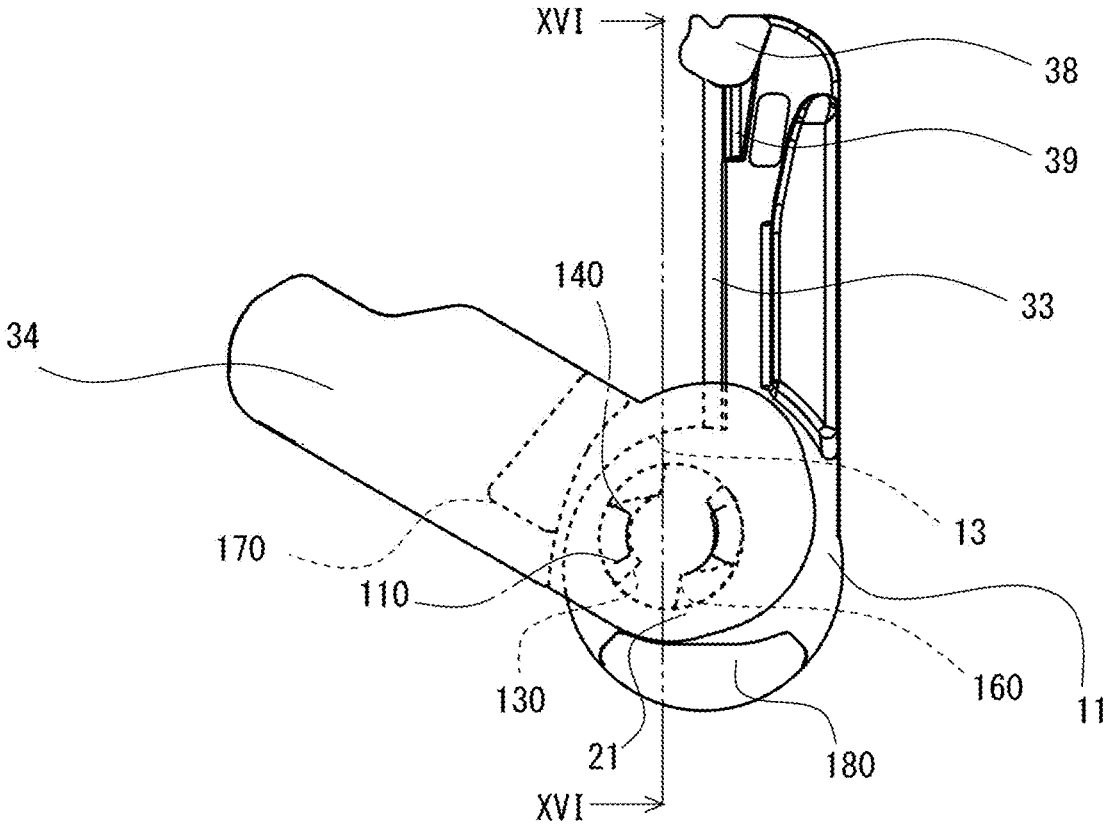
FIG. 14 is a schematic view of a stop member according to an exemplary embodiment of the present disclosure, schematically illustrating a manner of contact between first and second contact portions, i.e. a manner of contact between an arc-shaped sloped surface and a sliding portion.
Figure 15:
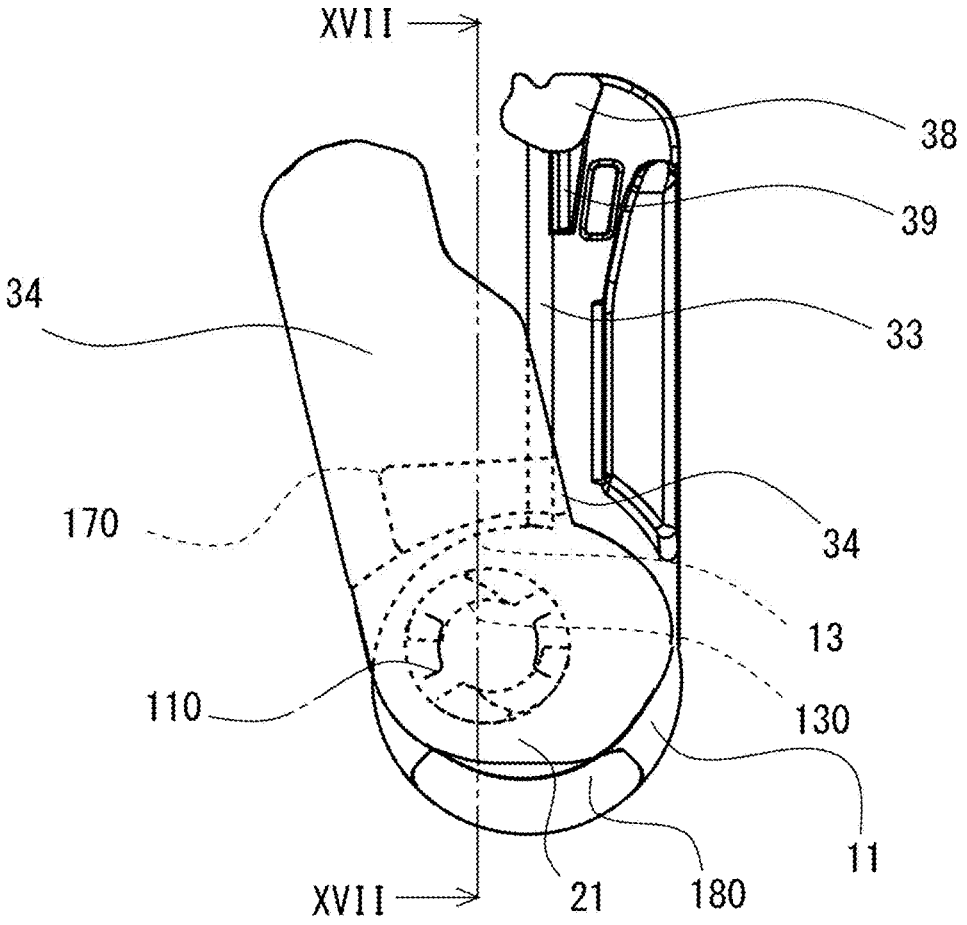
FIG. 15 is a schematic view of a stop member according to an exemplary embodiment of the present disclosure, schematically illustrating a manner of contact between first and second contact portions, i.e. a manner of contact between an arc-shaped sloped surface and a sliding portion. Comparison between FIG. 14 and FIG. 15 would schematically illustrate circumferential displacement of a protruded guide.

Comparison of FIGS. 14 and 15 would show that the protruded guide 170 is moved about the rotational axis AX, i.e. clockwise, when the sliding portion 140 of the first contact portion 110 descends the arc-shaped sloped surface 130 of the second contact portion 120. Comparison of FIGS. 16 and 17 would show that the protruded guide 170 is moved downward toward the bottom side of the opening in the axial direction of the rotational axis AX when the sliding portion 140 of the first contact portion 110 descends the arc-shaped sloped surface 130 of the second contact portion 120.

The slider 40 may be moved frontward from a position shown in FIG. 13 such that the relay element 38 of the first stop member 31 is moved closer to the second bar 34 and the first bar 33 is moved to and housed by the second bar 34 sufficiently and, in turn the first and second fastener elements 71, 72 initiate to be coupled.

Figure 18:
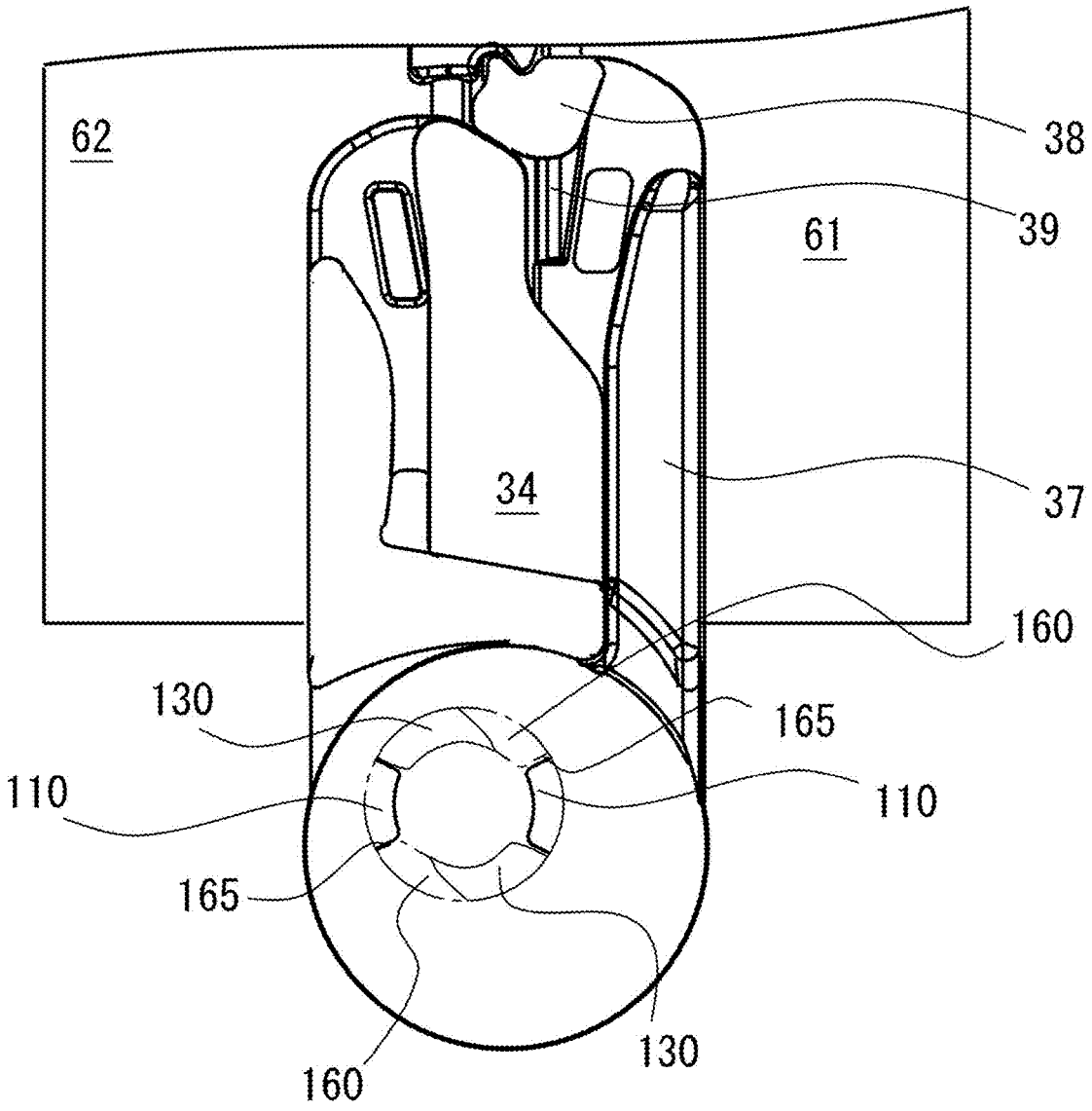
FIG. 18 is a partial top view of a slide fastener in closed state according to an exemplary embodiment of the present disclosure, particularly showing a separable stop member provided at the end of the slide fastener. In a circle of dash-dotted line, a state is schematically illustrated where the first contact portion is placed adjacent to the stopping surface of the second contact portion.
Figure 19:
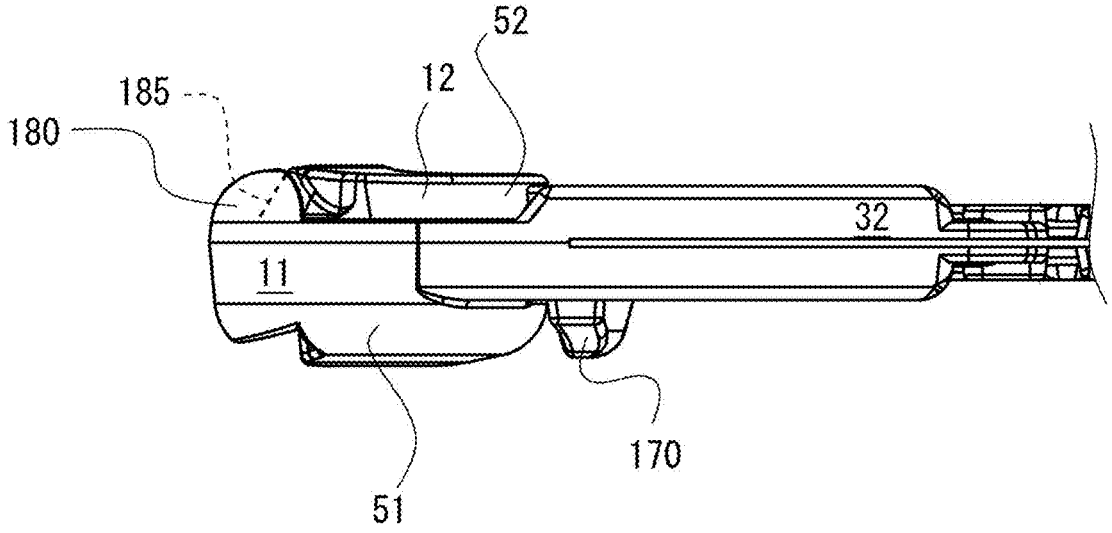
FIG. 19 is a side view of a slide fastener in a closed state according to an exemplary embodiment of the present disclosure, schematically showing a state where a housed portion of the second stop member is housed in a housing portion of the first stop member.
Figure 20:
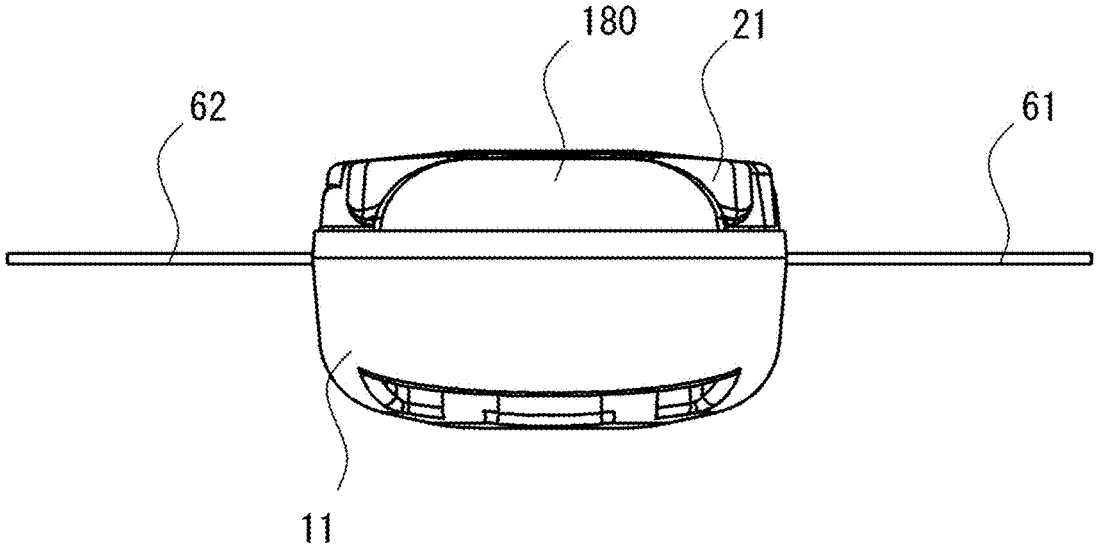
FIG. 20 is another side view of a slide fastener in a closed state according to an exemplary embodiment of the present disclosure.

In a case of FIGS. 18 to 20, the first contact portion 110 has finished descending the arc-shaped sloped surface 130 of the second contact portion 120. The first contact portion 110 is interposed between the adjacent second contact portions 120 in the circumferential direction. The first contact portion 110 is placed over or touches the second main body 21. The first contact portion 110 is placed adjacent to or touches the stopping surface 165 of the second contact portion 120. The first bar 33 is housed in the second bar 34, and the housed portion 185 is housed in the housing portion 180, achieving enhanced coupling of the first and second stop members 31, 32 in the up-down direction. Separation of the first and second stop members 31, 32 would be difficult unless the slider 40 moves back to the position over the second bar 34.

Figure 21:
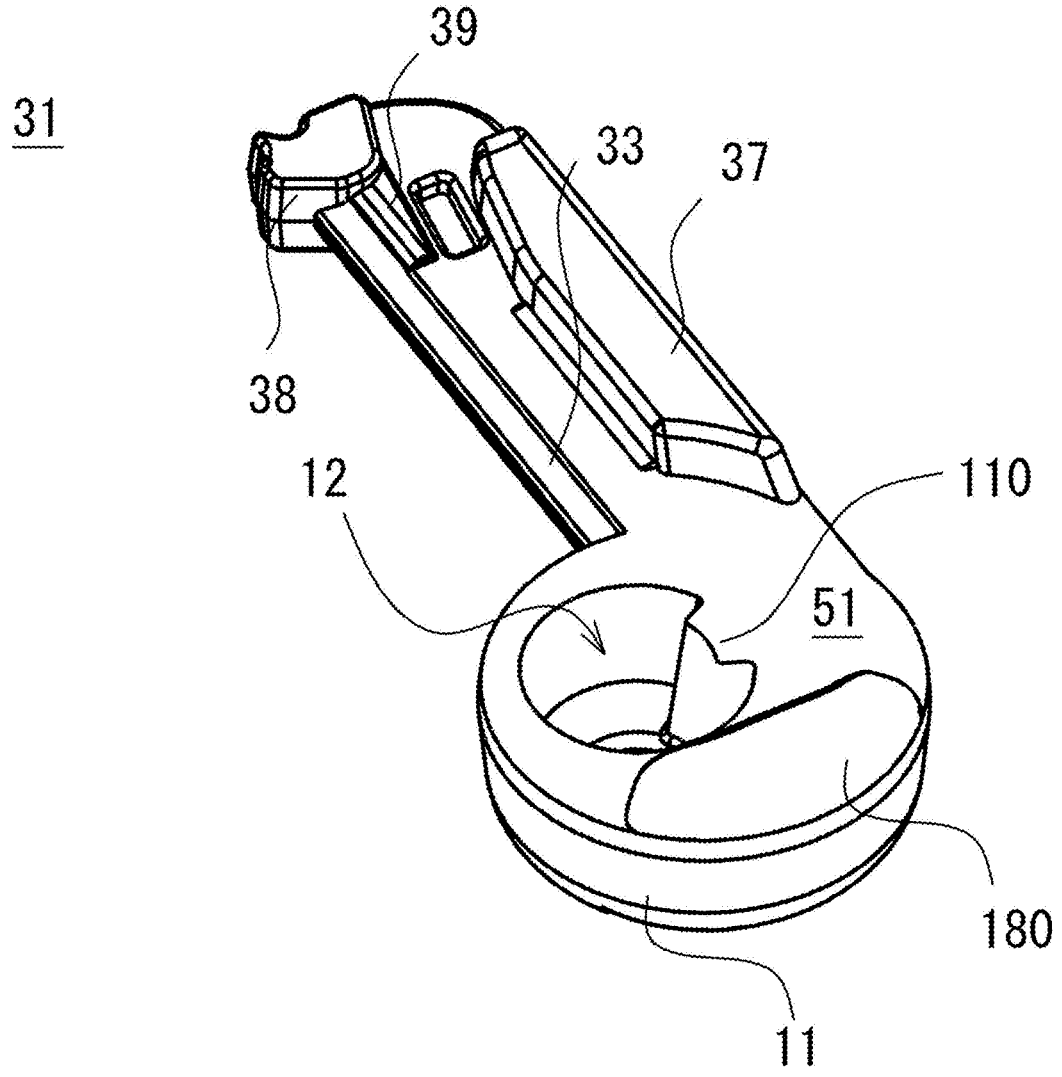
FIG. 21 is a schematic perspective view of a first stop member according to a first modified example of the present disclosure.
Figure 22:
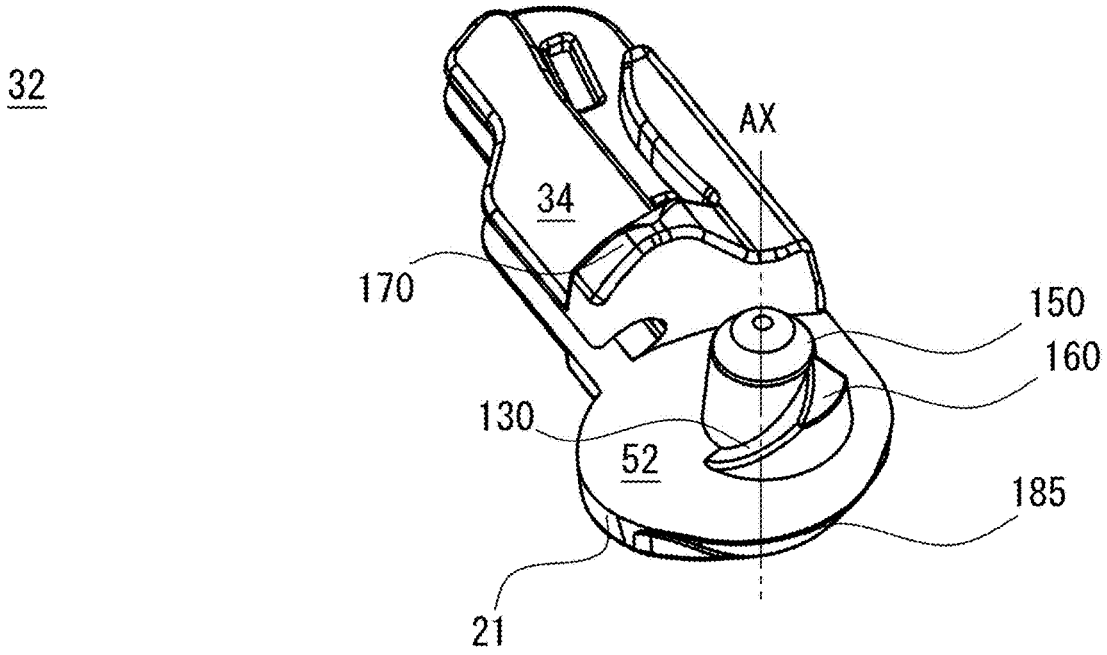
FIG. 22 is a schematic perspective view of a second stop member according to the first modified example of the present disclosure.

In a modified example shown in FIGS. 21 and 22, the first member 51 is provided with one first contact portion 110, and the second member 52 is provided with one second contact portion 120. Even in such a case, same or similar technical effects as above-described exemplary embodiments would be obtained. As stated in the beginning, overlapping descriptions will be basically omitted for the modified examples described below.

It should be noted that relative rotation between the first and second members 51, 52 would be stabilized where the first member 51 is provided with two or more first contact portions 110 and the second member 52 is provided with two or more second contact portions 120. In a case where the number of first contact portion 110 and the number of second contact portion 120 are equal, relative rotation between the first and second members 51, 52 would be stabilized.

Figure 23:
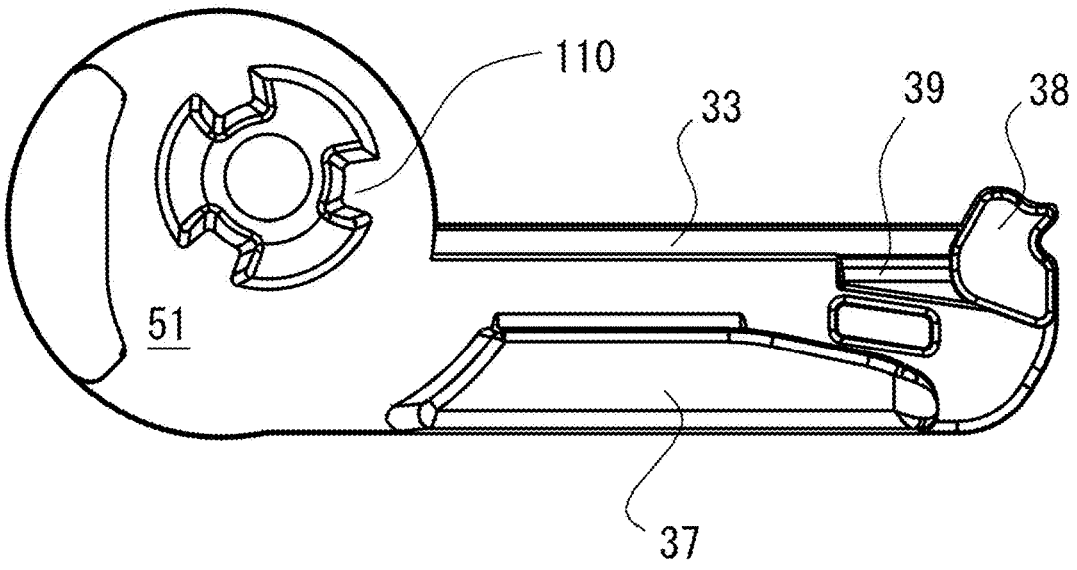
FIG. 23 is a schematic top view of a first stop member according to a second modified example of the present disclosure.
Figure 24:
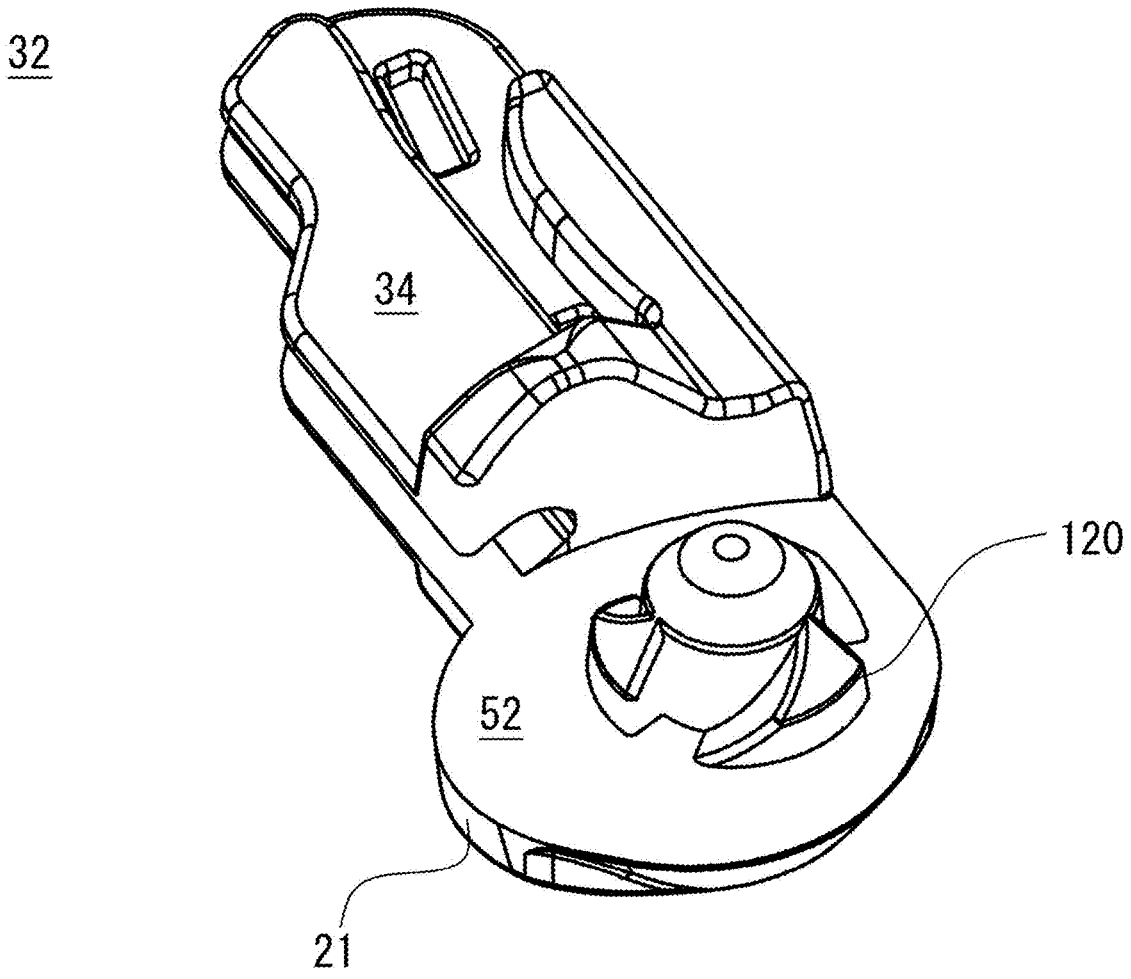
FIG. 24 is a schematic perspective view of a second stop member according to the second modified example of the present disclosure.
Figure 25:
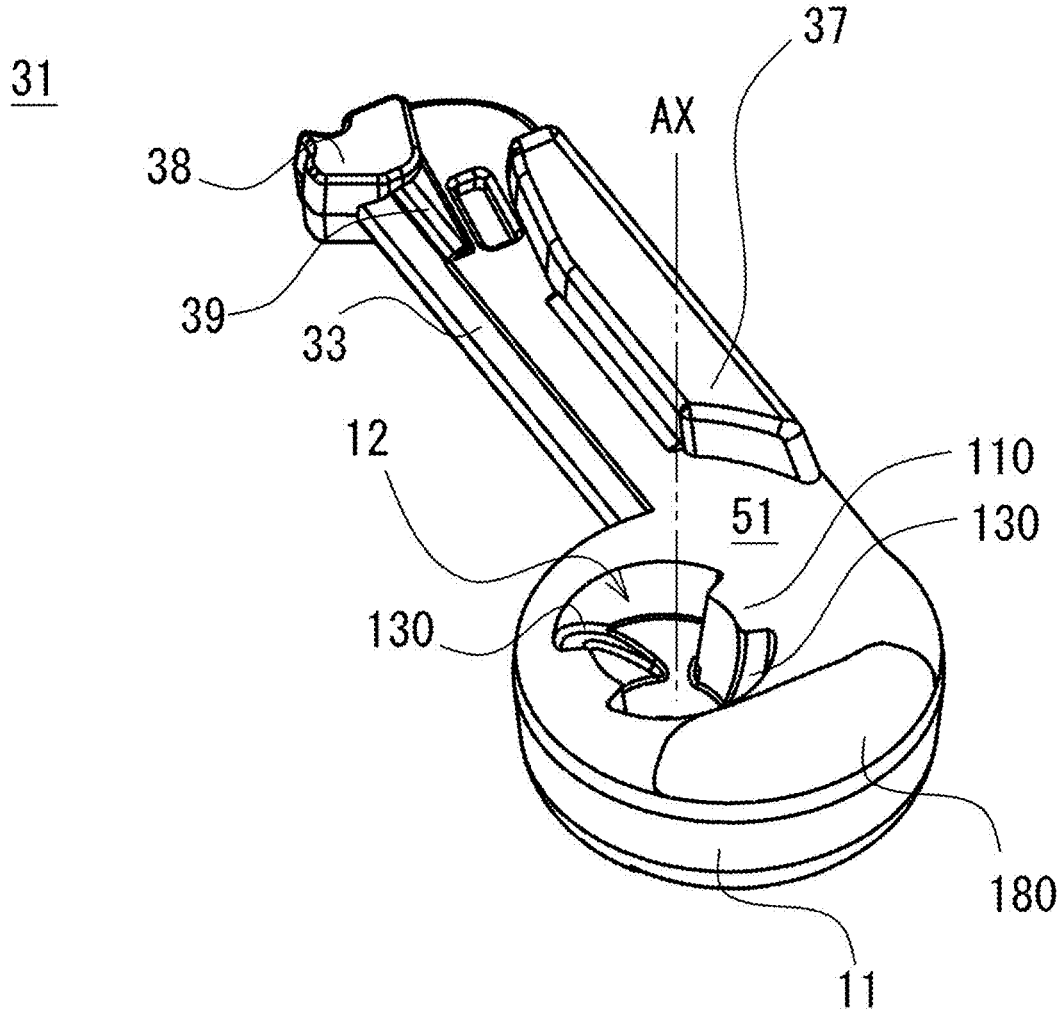
FIG. 25 is a schematic perspective view of a first stop member according to a third modified example of the present disclosure.
Figure 26:
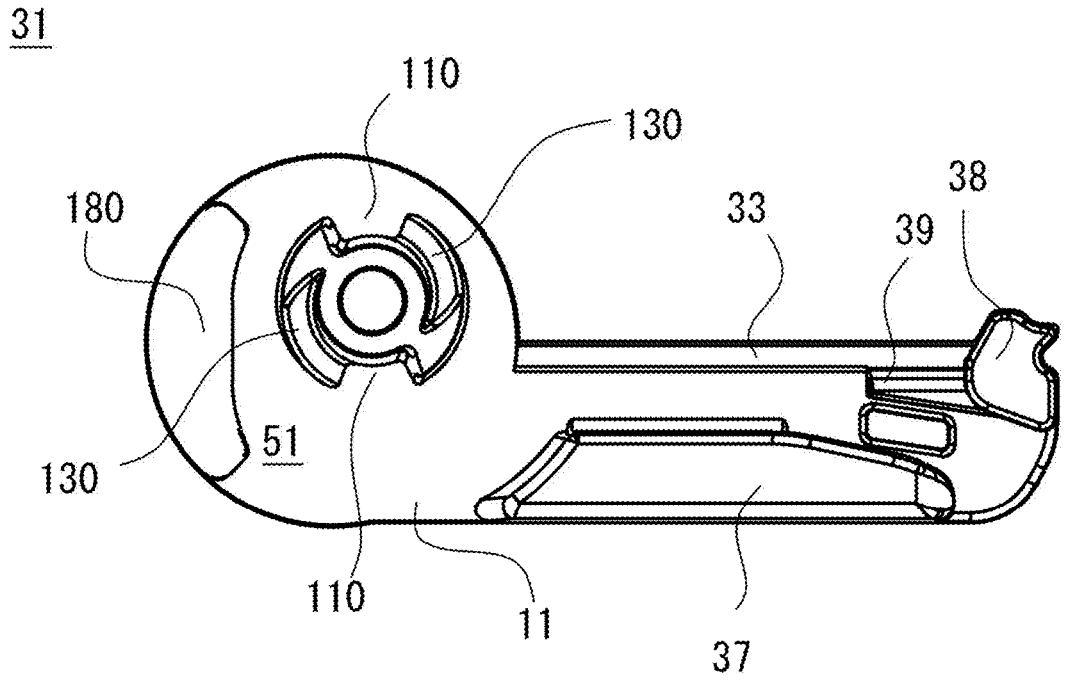
FIG. 26 is a schematic top view of a first stop member according to the third modified example of the present disclosure.
Figure 27:
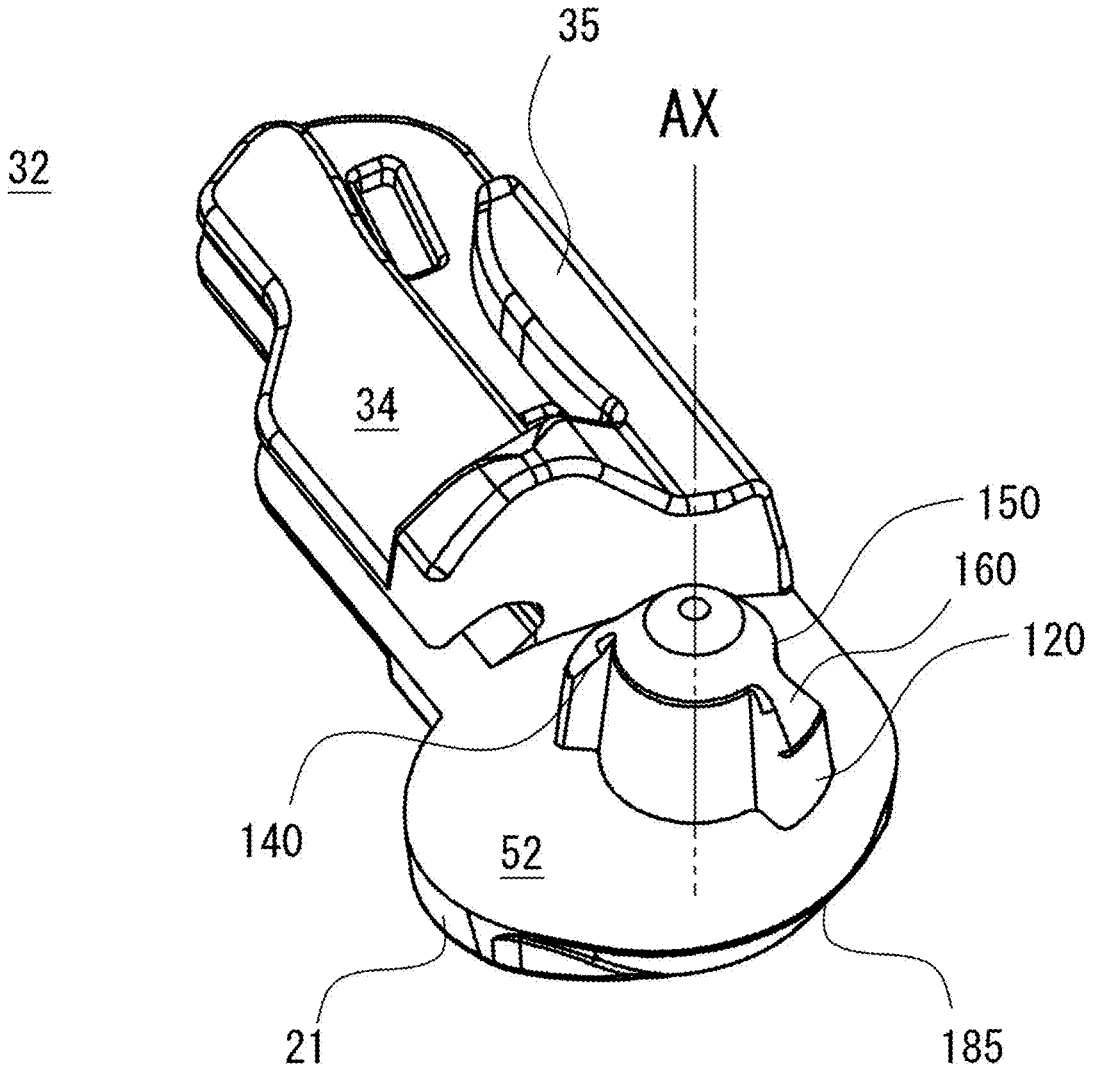
FIG. 27 is a schematic perspective view of a second stop member according to the third modified example of the present disclosure.
Figure 28:
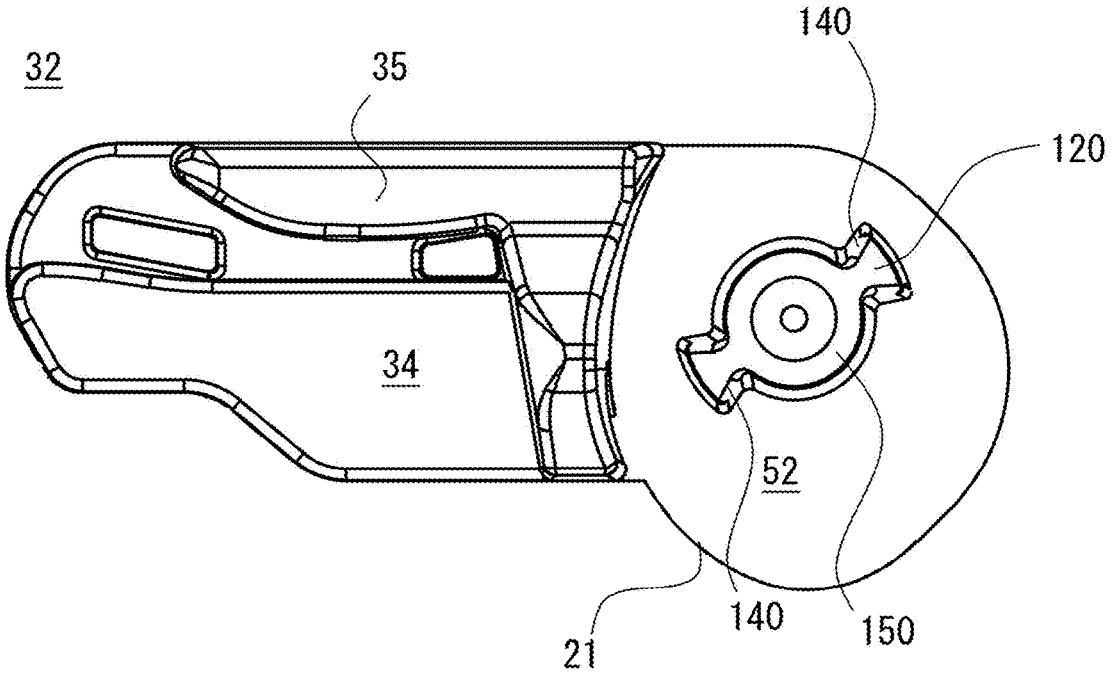
FIG. 28 is a schematic top view of a second stop member according to the third modified example of the present disclosure.
Figure 29:
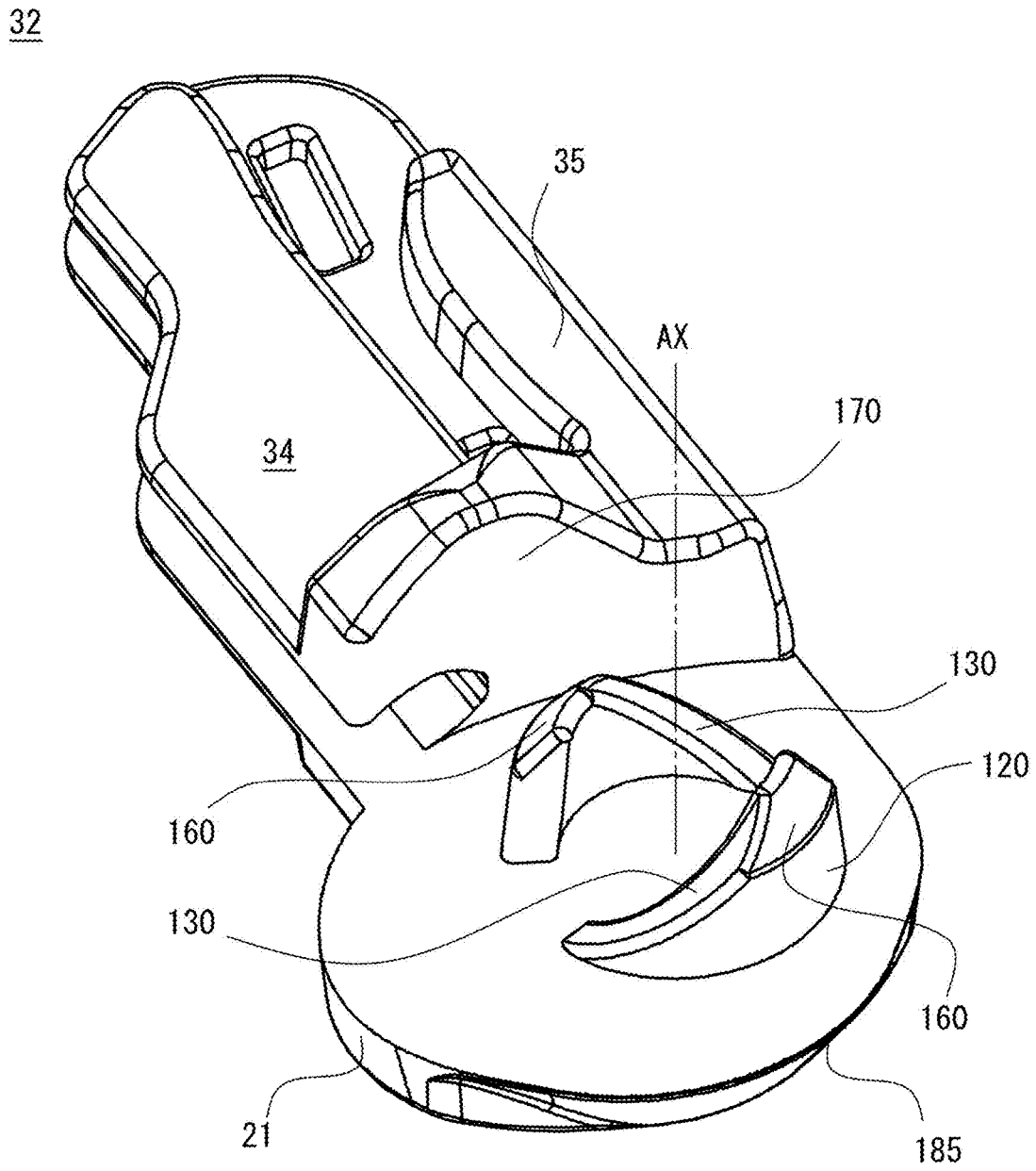
FIG. 29 is a schematic perspective view of a second stop member according to a fourth modified example of the present disclosure.
Figure 30:
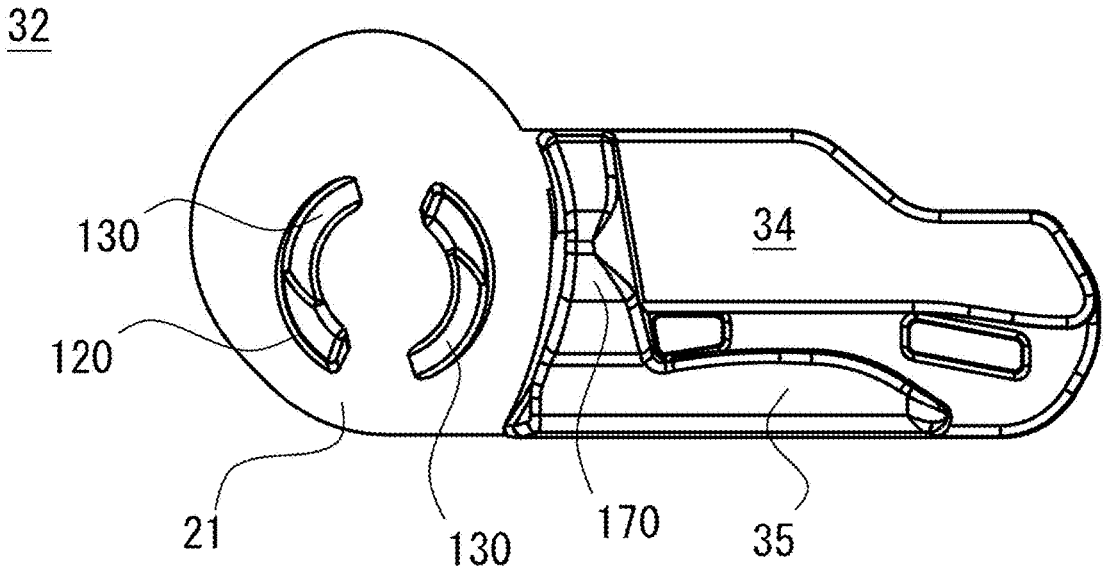
FIG. 30 is a schematic top view of a second stop member according to the fourth modified example of the present disclosure.
Figure 31:
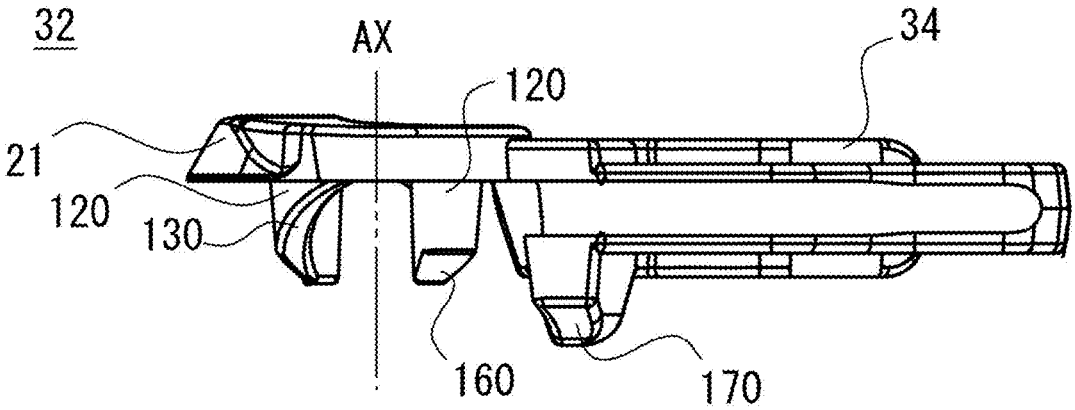
FIG. 31 is a schematic side view of a second stop member according to the fourth modified example of the present disclosure.
Figure 32:
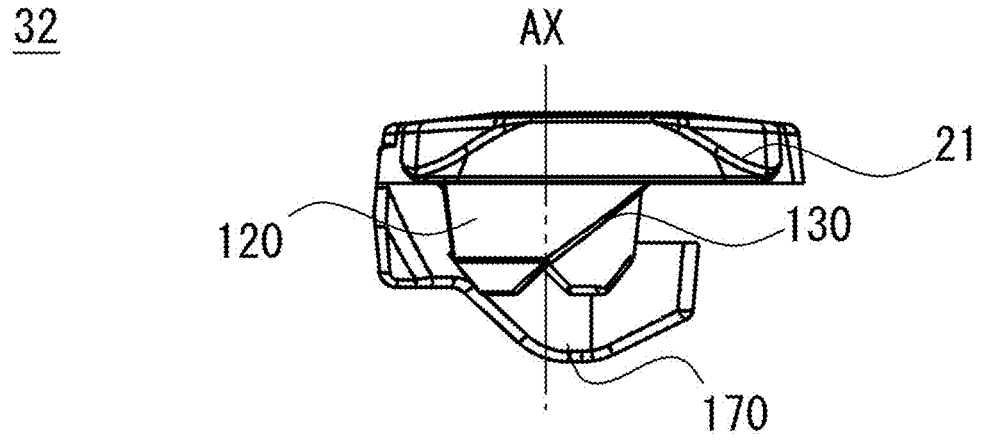
FIG. 32 is another schematic side view of a second stop member according to the fourth modified example of the present disclosure.
Figure 33:
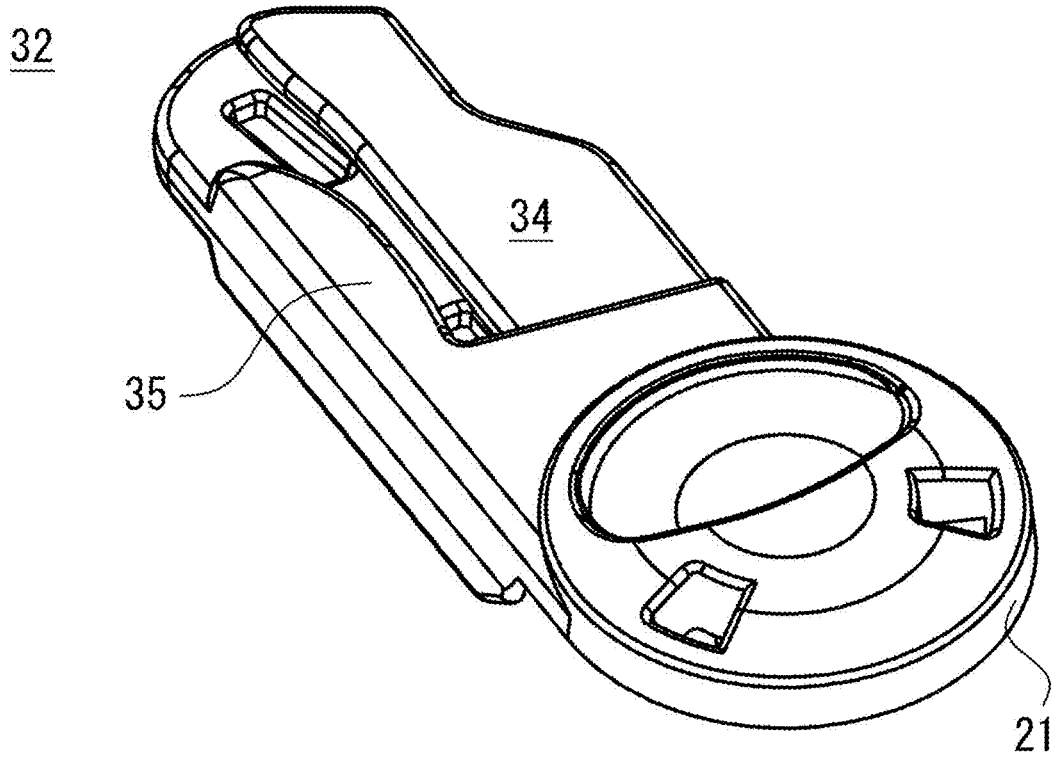
FIG. 33 is a schematic perspective view of a second stop member according to a fifth modified example of the present disclosure.

In a modified example shown in FIGS. 23 and 24, the first member 51 is provided with three first contact portions 110, and the second member 52 is provided with three second contact portions 120. Even in such a case, same or similar technical effects as above-described exemplary embodiments would be obtained. A skilled person in the art would envision further modified examples where four or more first and second contact portions 110, 120 are provided.

In a modified example shown in FIGS. 25-28, differently from the above embodiments or examples, the first contact portion 110 of the first member 51 is provided with the arc-shaped sloped surface 130. In contrast, the second contact portion 120 of the second member 52 is provided with the sliding portion 140 that slides on the arc-shaped sloped surface 130. Even in such a case, same or similar technical effects as above-described exemplary embodiments would be obtained.

The arc-shaped sloped surface 130 extends toward the bottom-side of the opening 12 of the first main body 11. The second contact portion 120 is a protrusion with the sloped guide surface 160. An edge of the second contact portion 120 that extends to cross the circumferential direction of the rotational axis AX is equal to the sliding portion 140.

In a modified example shown in FIGS. 29-32, differently from the above embodiments or examples, the axial portion 150 is omitted. Even in such a case, same or similar technical effects as above-described exemplary embodiments would be obtained except for the effects originated from the axial portion 150.

In a modified example shown in FIGS. 33-42, differently from the above embodiments or examples, the housing portion 180 and the housed portion 185 are omitted. Even in such a case, same or similar technical effects as above-described exemplary embodiments would be obtained except for the effects originated from the housing portion 180 and the housed portion 185.

Figure 34:
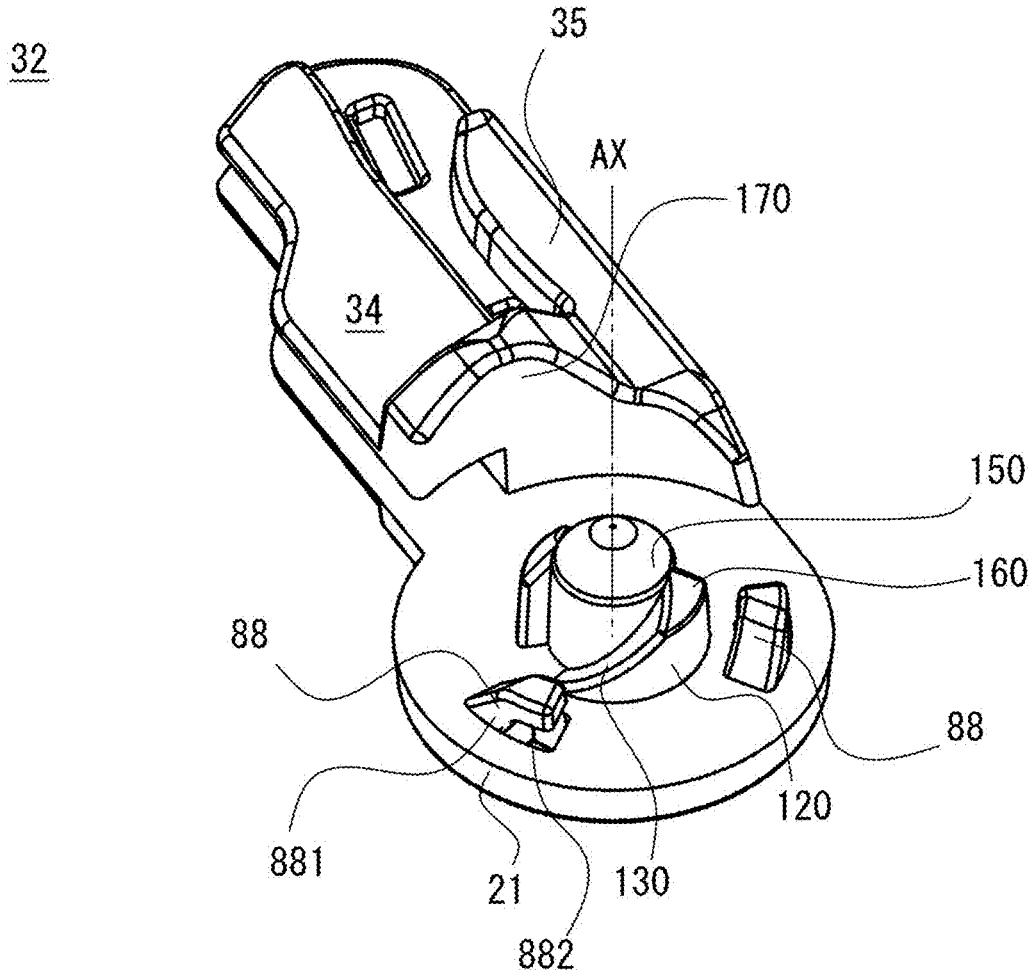
FIG. 34 is a schematic perspective view of a second stop member according to the fifth modified example of the present disclosure, showing the opposite side of FIG. 33.
Figure 35:
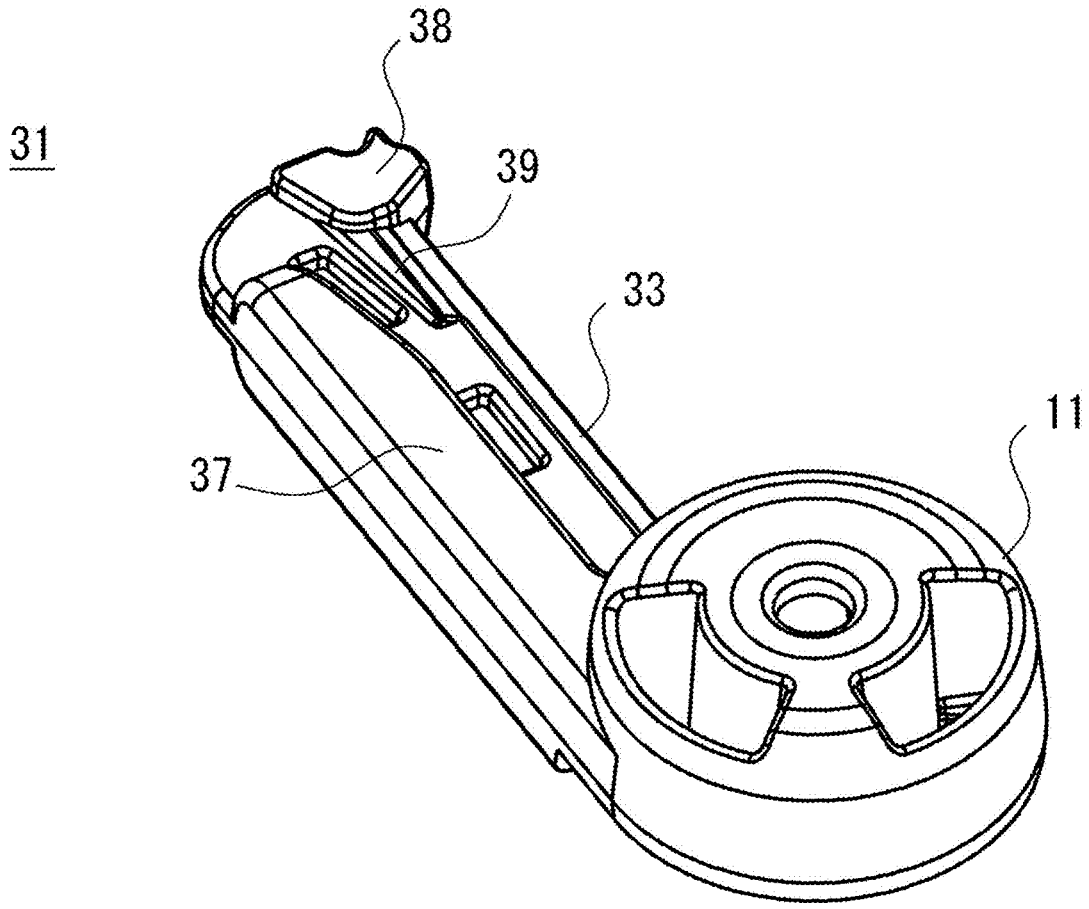
FIG. 35 is a schematic perspective view of a first stop member according to the fifth modified example of the present disclosure.

As shown in FIG. 34, one or more nails 88, e.g. plural i.e. two nails 88 in the illustrated example, are provided on the main surface of the second main body 21 of the second member 52 on which the second contact portion 120 and/or the axial portion 150 is provided. The nails 88 are directed along the circumferential direction about the rotational axis AX. The nail 88 has a base 881 coupled to the second main body 21 and a head 882 extending from the base 881 along the circumferential direction.

Figure 36:
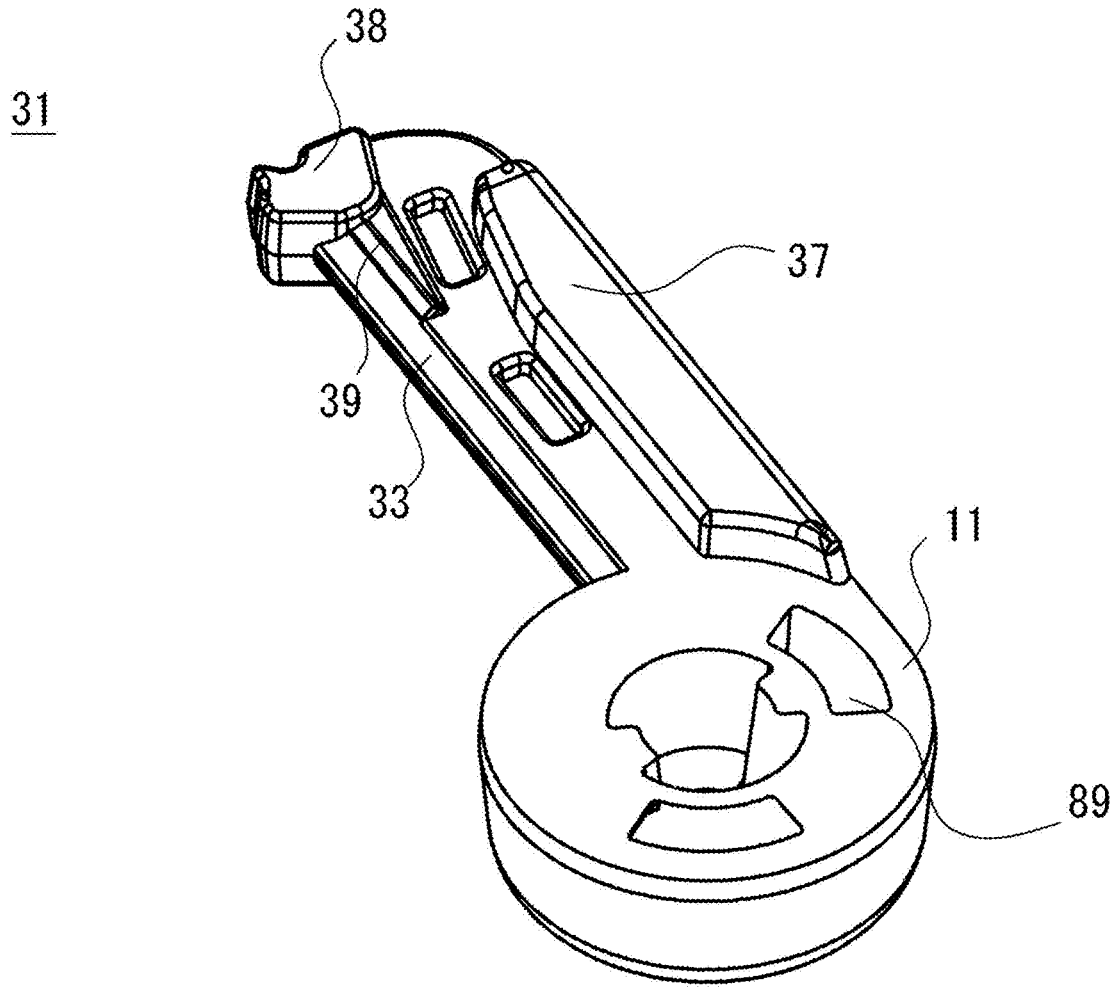
FIG. 36 is a schematic perspective view of a first stop member according to the fifth modified example of the present disclosure, showing the opposite side of FIG. 35.
Figure 37:
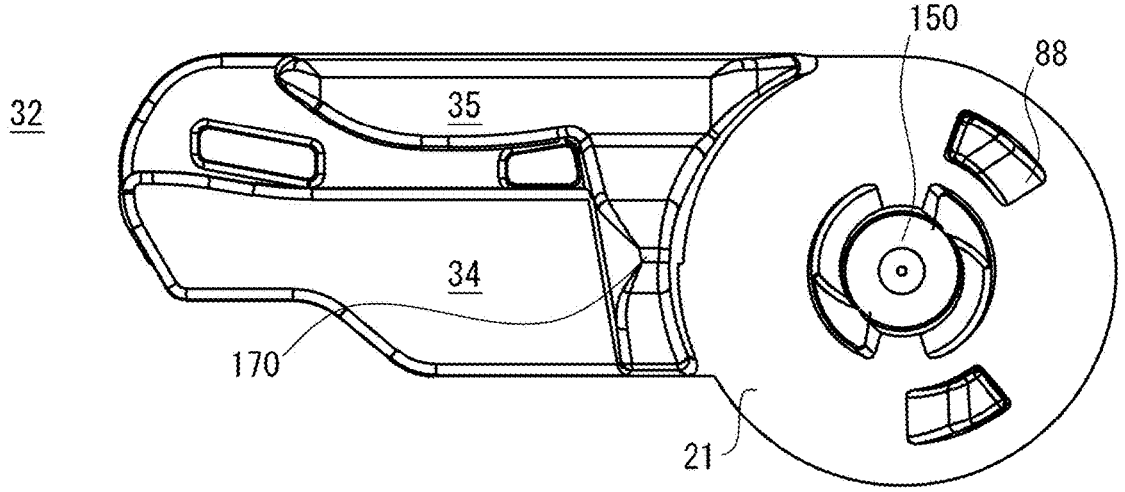
FIG. 37 is a schematic bottom view of a second stop member according to the fifth modified example of the present disclosure.

As shown in FIG. 36, hole(s) 89 for housing the nail 88, e.g. plural i.e. two holes 89 in the illustrated example, are provided onto the main surface of the first member 51 on which the opening 12 is provided. The hole 89 extends along the circumferential direction about the rotational axis AX. As would be understood from FIG. 42, a locking protrusion 891 is provided in the hole 89 that is protruded from the wall surface of the hole 89 along the circumferential direction.

As the sliding portion 140 of the first contact portion 110 descends the arc-shaped sloped surface 130 of the second contact portion 120, the nail 88 enters into the hole 89 and the nail 88 is finally fitted with the locking protrusion 891 in the hole 89. That is, the locking protrusion 891 is sandwiched between the head 882 of the nail 88 and the main surface of the second main body 21 on which the nail 88 is provided.

Figure 38:
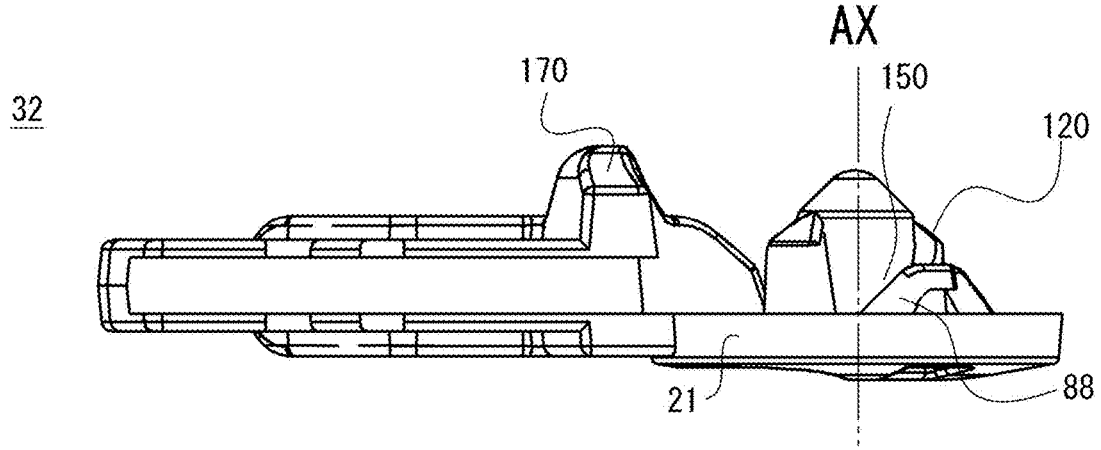
FIG. 38 is a schematic side view of a second stop member according to the fifth modified example of the present disclosure.
Figure 39:
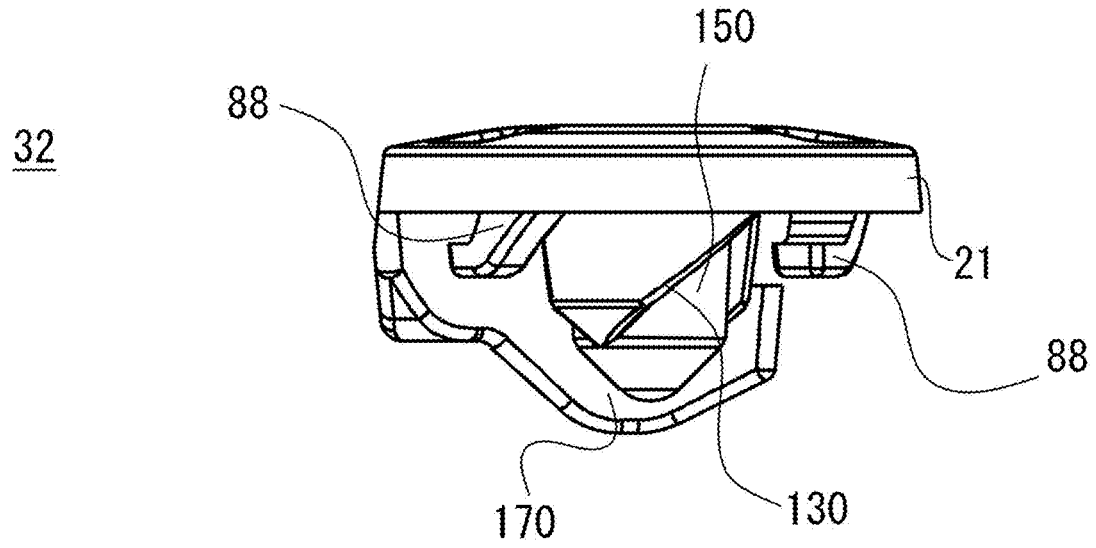
FIG. 39 is another schematic side view of a second stop member according to the fifth modified example of the present disclosure.
Figure 40:
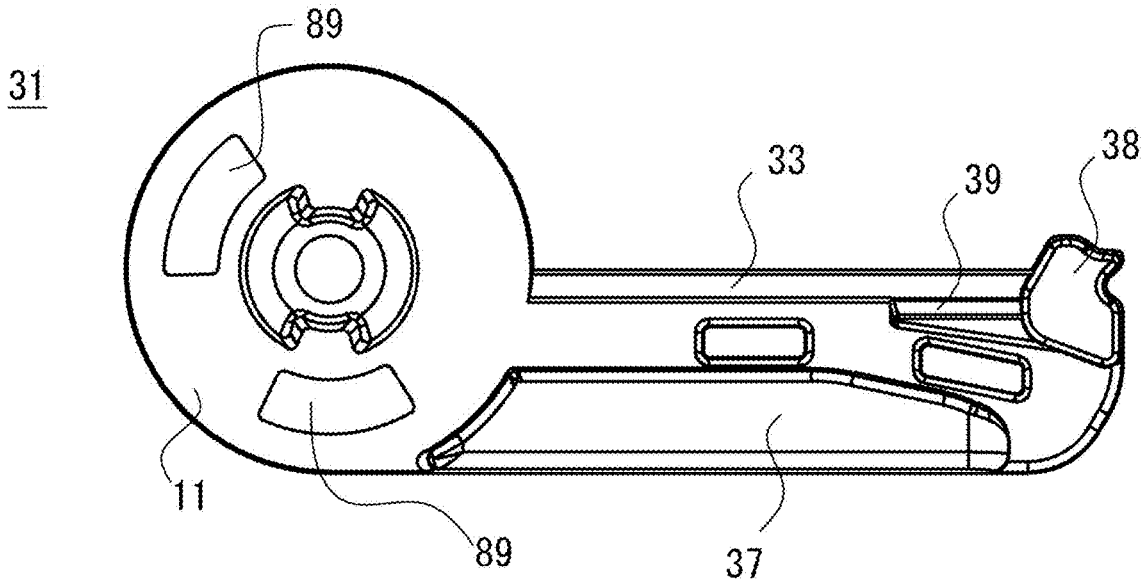
FIG. 40 is a schematic top view of a first stop member according to the fifth modified example of the present disclosure.
Figure 41:
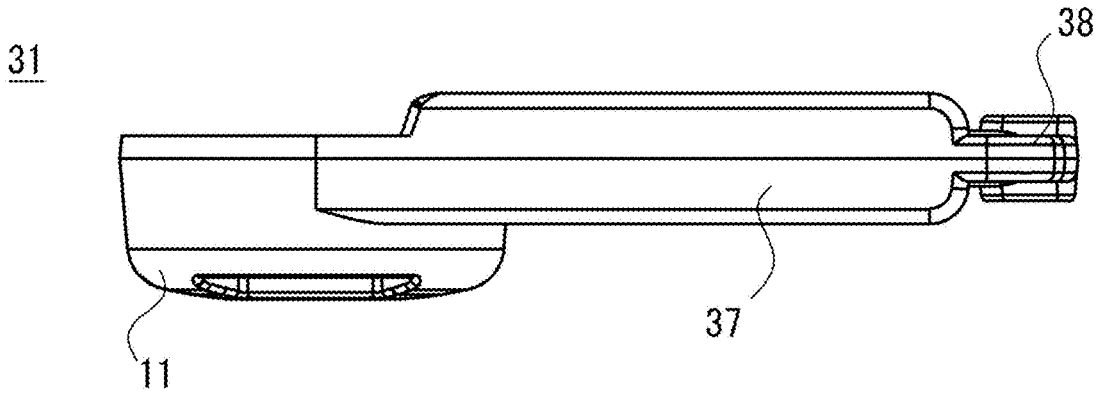
FIG. 41 is a schematic side view of a first stop member according to the fifth modified example of the present disclosure.
Figure 42:
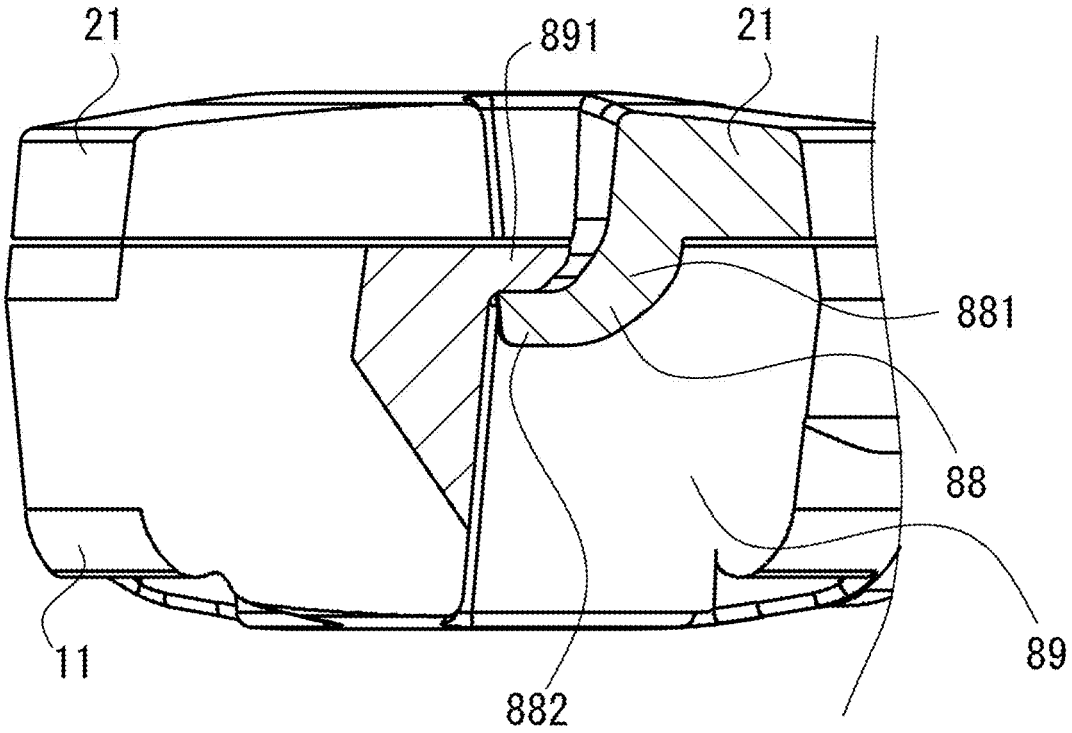
FIG. 42 is a view showing a manner of couple between first main body of first stop member and second main body of second stop member according to the fifth modified example of the present disclosure.

As shown in FIG. 38, an outer peripheral part of the second main body 21 is not thinned, enhancing its mechanical strength. As shown in FIG. 41, a housing portion 180 is not provided onto the first main body 11, allowing the first main body 11 to be thinner.

Given the above teachings, a skilled person in the art would be able to add various modifications to the respective embodiments. Reference numerals in Claims are just for reference and should not be referred for the purpose of narrowly construing the scope of claims.

REFERENCE SIGNS LIST

5 Rotational mechanism
30 Stop member
90 Slide fastener
11 First main body
12 Opening
21 Second main body
51 First member
52 Second member
110 First contact portion
120 Second contact portion
130 Arc-shaped sloped surface
140 Sliding portion
AX Rotational axis

The invention claimed is:

1. A rotational mechanism of a separable stop member for a slide fastener, the rotational mechanism comprising:

a first member that comprises a first main body, an opening provided in the first main body, and one or more first contact portions provided in the opening; and a second member that comprises a second main body, and one or more second contact portions provided, as a protrusion, in the second main body, wherein one of the first and second contact portions includes an arc-shaped surface sloped as extending in an arc about a rotational axis, and the other one of the first and second contact portions includes a sliding portion that slides on the arc-shaped surface about the rotational axis, and wherein as the sliding portion slides on the arc-shaped surface about the rotational axis, an axial spacing between the first and second main bodies along the rotational axis is reduced and simultaneously at least one of the first and second main bodies is rotated about the rotational axis.

2. The rotational mechanism according to claim 1, wherein the first member comprises two or more first contact portions, and the second member comprises two or more second contact portions.

3. The rotational mechanism according to claim 1, wherein the number of first contact portion and the number of second contact portion are equal.

4. The rotational mechanism according to claim 1, wherein the sliding portion is an edge of the first or second contact portion.

5. The rotational mechanism according to claim 1, wherein one of the first and second contact portions includes a stopping surface that prevents the other one of the first and second contact portions from circumferentially moving about the rotational axis.

6. The rotational mechanism according to claim 1, wherein the first contact portion is protruded from a wall surface of the opening, the wall surface extending in a depth direction of the opening.

7. The rotational mechanism according to claim 1, wherein the second member further comprises an axial portion to which the one or more second contact portions are coupled from radially outward of the axial portion.

8. The rotational mechanism according to claim 1, wherein a terminal end of the axial portion is positioned farther away from a terminal end of the second contact portion relative to the second main body.

9. The rotational mechanism according to claim 1, wherein the one or more second contact portions further includes a sloped guide surface that descends radially outwardly of the rotational axis.

10. The rotational mechanism according to claim 1, wherein the second contact portion has a side surface that touches a wall surface defining the opening.

11. The rotational mechanism according to claim 1, wherein the first main body has an outer peripheral part positioned around the opening, and the second member has a protruded guide positioned around the outer peripheral part when the sliding portion slides on the arc-shaped surface.

12. The rotational mechanism according to claim 1, wherein one of the first and second main bodies is provided with a housing portion, and the other one of the first and second main bodies is provided with a housed portion housed in the housing portion, and wherein the sliding portion slides on the arc-shaped surface so that the housed portion moves from a position where the housed portion is not housed in the housing portion to a position where the housed portion is housed in the housing portion.

13. The rotational mechanism according to claim 12, wherein the housing portion has an inner surface defining an axial spacing with one of the first and second main bodies, the housed portion has a slant surface, and the slant surface of the housed portion faces or touches the inner surface of the housing portion as the sliding portion slides on the arc-shaped surface.

14. A separable stop member for a slide fastener, the separable stop member comprising:

a first stop member that comprises the first member of the rotational mechanism claim 1, and one of first and second bars coupled to the first member; and a second stop member that comprises the second member of the rotational mechanism of claim 1, and the other one of the first and second bars coupled to the second member, wherein the first bar is inserted into a slider through an interspace between a top flange and a bottom flange of the slider, and wherein the second bar is inserted into the slider through a rear mouth of the slider.

15. The separable stop member according to claim 14, wherein the second bar is configured to house the first bar at least partially.

16. A slide fastener comprising:

a first fastener stringer that comprises a first fastener tape, a first fastener element coupled to the first fastener tape, and a first stop member that is coupled to the first fastener tape adjacently to the first fastener element;

a second fastener stringer that comprises a second fastener tape, a second fastener element coupled to the second fastener tape, and a second stop member that is coupled to the second fastener tape adjacently to the second fastener element; and a slider for opening and closing the first and second fastener stringers, wherein the first stop member comprises a first main body, an opening provided in the first main body, and one or more first contact portions provided in the opening, the second stop member comprises a second main body, and one or more second contact portions provided, as a protrusion, in the second main body, one of the first and second contact portions includes an arc-shaped surface sloped as extending in an arc about a rotational axis, and the other one of the first and second contact portions includes a sliding portion that slides on the arc-shaped surface about the rotational axis, and as the sliding portion slides on the arc-shaped surface about the rotational axis, an axial spacing between the first and second main bodies along the rotational axis is reduced and simultaneously at least one of the first and second main bodies is rotated about the rotational axis.

17. The slide fastener according to claim 16, wherein the first stop member further comprises one of first and second bars, and the second stop member further comprises the other one of the first and second bars, and wherein the first bar is inserted into the slider through an interspace between a top flange and a bottom flange of the slider, and the second bar is inserted into the slider through a rear mouth of the slider.

18. The slide fastener according to claim 17, wherein the second bar is configured to house the first bar at least partially when the slide fastener is closed.

* * * * *